US005473914A

United States Patent [19]

Pyo et al.

[11] Patent Number: 5,473,914

[45] Date of Patent: Dec. 12, 1995

[54] DETERGENT DISSOLVING DEVICE FOR WASHER

[75] Inventors: Sang-Yun Pyo, Suwon; Hong-Sung Kim, Seoul; Un-Jung Yun, Suwon, all of Rep. of Korea

[73] Assignee: Samsung Electronics Co., Ltd., Suwon, Rep. of Korea

[21] Appl. No.: 351,551

[22] Filed: Dec. 7, 1994

Related U.S. Application Data

[63] Continuation of Ser. No. 68,347, May 28, 1993, abandoned.

[30] Foreign Application Priority Data

| | | | |
|---|---|---|---|
| Jun. 1, 1992 | [KR] | Rep. of Korea | 92-9664 U |
| Jun. 5, 1992 | [KR] | Rep. of Korea | 92-9810 |
| Jun. 29, 1992 | [KR] | Rep. of Korea | 92-11785 U |
| Jul. 22, 1992 | [KR] | Rep. of Korea | 92-13556 U |
| Jul. 28, 1992 | [KR] | Rep. of Korea | 92-13525 |
| Sep. 22, 1992 | [KR] | Rep. of Korea | 92-18040 U |

[51] Int. Cl.[6] ..... D06F 39/02

[52] U.S. Cl. ..... 68/17 R

[58] Field of Search ..... 68/17 R; 134/93; 137/268; 422/263, 266, 267, 276; 99/295, 302 R, 307

[56] References Cited

U.S. PATENT DOCUMENTS

| | | | |
|---|---|---|---|
| 3,127,067 | 3/1964 | Hall et al. | 68/17 R X |
| 3,513,866 | 5/1970 | Boothe et al. | 68/17 R |
| 3,567,076 | 3/1971 | Zanussi | 68/17 R |
| 3,952,556 | 4/1976 | Gakhar et al. | 68/17 R X |

FOREIGN PATENT DOCUMENTS

| | | | |
|---|---|---|---|
| 0330879 | 9/1989 | European Pat. Off. | 68/17 R |
| 2724426 | 12/1978 | Germany | 68/17 R |
| 1938880 | 7/1980 | Germany | 68/17 R |
| 3021999 | 3/1981 | Germany | 68/17 R |
| 3804302 | 8/1989 | Germany | 134/93 |
| 56-106698 | 8/1981 | Japan . | |
| 257596 | 10/1988 | Japan | 68/17 R |
| 1231184 | 5/1971 | United Kingdom | 68/17 R |
| 2104109 | 3/1983 | United Kingdom | 68/17 R |

*Primary Examiner*—Philip R. Coe

*Attorney, Agent, or Firm*—Burns, Doane, Swecker & Mathis

[57] ABSTRACT

A detergent dissolving device for a washer comprising an acceleration unit for accelerating a flow rate of a washing water supplied from a water supply hose, and a detergent containing unit for containing a detergent therein and dissolving the detergent by a pressure of the washing water received from the acceleration unit. The detergent is introduced into a filtering screen unit seated in the detergent containing unit. The detergent is dissolved by the pressure of the washing water received from the acceleration unit.

5 Claims, 19 Drawing Sheets

125
111
112
110
113a
113
114
130b
130a
130
121a
121e
121
121b
121f
124
122d
122
122f
122b
122g
122h
121g
122c
122e
124a
122j
124
121c
121d
123
122k
122a
122i
120
100

DETERGENT DISSOLVING DEVICE FOR WASHER

This application is a Continuation of application Ser. No. 08/068,347, filed May 28, 1993 now abandoned.

BACKGROUND OF THE INVENTION

1. Field of the Invention

The present invention relates to a washer for clothes, and more particularly to a detergent dissolving device for such a washer, capable of dissolving a detergent by using a washing water to be used for washing clothes, prior to a normal washing operation of the washer.

2. Description of the Prior Art

Referring to FIG. 1, there is illustrated a general full-automatic washer. As shown in FIG. 1, the washer comprises a body 1 and a washing tub 2 fixedly mounted in the body 1. Beneath the washing tub 2, a motor 3 is fixedly mounted on the lower surface of the washing tub 2. Within the washing tub 2, a washing and dehydrating tub (hereinafter referred to simply as the dehydrating tub) 4 is disposed to rotate so that it performs a dehydration for clothes by virtue of a centrifugal force generated by its rotation. A pulsator 5 is disposed in the dehydrating tub 4, to generate a flow of water while rotating reversibly according to the drive force of the motor 3, thereby performing a washing.

At the upper portion of the body 1, a water supply unit 7 is mounted, which is connected with a tap 6, for supplying water in the washing tub 2. Beneath the washing tub 2, a drain unit 8 is provided at one side of the washing tub 2, so as to drain washing water out of the washing tub 2.

In the full-automatic washer with the above-mentioned construction, when a washing condition is selected after clothes to be washed have been poured in the dehydrating tub 4, warm or cold water is supplied in the dehydrating tub 4, through the water supply unit 7. As the motor 3 is then driven, the pulsator 5 rotates alternatingly in a normal direction and the reverse direction and thus generates a flow of water, so that a washing is performed. After the completion of washing, the washing water is drained out of the washer, according to an operation of the water drain unit 8. Thereafter, supplying of water through the water supply unit 7 is carried out again and rinsing operations are then performed several times. Finally, a dehydration is carried out by rotating the dehydrating tub 4 at a high speed, so that the overall washing operation is completed.

Upon the washing, a detergent in the form of powder is generally poured in the dehydrating tub, together with clothes to be washed, so as to improve the washability. Conventionally, the user pours a proper quantity of detergent directly or by using a separate detergent pouring member.

With the pouring of detergent in a manner as mentioned above, however, it is difficult to dissolve well the detergent powder in the washing water, thereby causing the washability to be degraded. It also results in an increase in detergent quantity used. A spoil may also occur at the clothes, due to the detergent not dissolved, thereby causing the clothes to be damaged.

For solving these problems, there has been conventionally proposed a construction for improving a solubility of detergent. Such a construction is illustrated in FIG. 2. In accordance with the construction, the water supply unit 7 comprises a pair of water supply valves 7*a* and 7*b* which are adapted for a warm water and a cold water, respectively. The water supply unit 7 also comprises a water supply pipe 7*c* disposed downstream of the water supply valves 7*a* and 7*b*. Within the water supply pipe 7*c*, a detergent container 9 containing a detergent C therein is disposed so that a washing water from the water supply pipe 7*c* dissolves the detergent contained in the detergent container 9 while passing through the detergent container 9, thereby enabling the dissolved detergent to be supplied in the washing tub 2. With this construction, however, a complete solution of the detergent cannot be expected. Lumps of detergents not dissolved may enter the washing tub 2, thereby degrading the washability. They also may result in spoils on the clothes, thereby causing the clothes to get damaged. There is also a problem of an environmental contamination caused by the discharging of the detergent not dissolved.

Conventionally, another detergent dissolving device for a washer has been disclosed in Japanese Patent Laid-open Publication No. Sho. 56-106698. As shown in FIG. 3, the device comprises a container 10 mounted at the upper portion of the washing tub 2 and adapted to contain a quantity of liquid sufficient to dissolve a quantity of detergent predetermined according to a regulated quantity of washing water in the washing tub 2. The device also comprises a heater 11 for heating the liquid contained in the container 10 and an agitating vane 13 disposed in the container 10 to rotate according to the driving of a motor 12.

With this detergent dissolving device, the solution of the detergent can be more or less expected, by virtue of the electrically activated heater 11 and the agitating vane 13. However, the device requires long time for heating the washing water contained in the container 10. As a result, there is a problem of increased in washing time and electric power consumption. Furthermore, the overall construction becomes complex, due to the provisions such as the motor for driving the agitating vane and the heater. Since the detergent is dissolved in the washing water contained in the container having a limited capacity, it may be impossible to dissolve completely the detergent when the quantity of detergent to be poured is large. This causes various problems such as contaminations of environmental factors, in particular, the quality of water.

SUMMARY OF THE INVENTION

Therefore, the present invention has been made in view of the above-mentioned problems encountered in the prior arts and thus an object of the invention is to provide a detergent dissolving device for a washer, capable of completely dissolving a detergent poured in the washer upon washing and supplying it together with a washing water, thereby improving a washing efficiency and considerably reducing an environmental contamination.

Another object of the invention is to provide a detergent dissolving device for a washer, capable of completely dissolving a detergent, with a simple construction, and thus reducing the quantities of detergent and washing water used.

In accordance with one aspect, the present invention provides, in a washer comprising a washer body, a washing and dehydrating tub mounted in the washer body and means for supplying a predetermined amount of a washing water in the washing and dehydrating tub, a detergent dissolving device comprising means for supplying an oxygen to the washing water, so as to dissolve a detergent, the oxygen supplying means being provided at the water supplying means.

In accordance with another aspect, the present invention provides, in a washer comprising a washing and dehydrating tub, a detergent dissolving device comprising means for accelerating a flow of a washing water and transmitting a pressure of the accelerated washing water to a detergent, the water flow accelerating means disposed above the washing and dehydrating tub.

In accordance with another aspect, the present invention provides a detergent dissolving device for a washer comprising a washing and dehydrating tub, the device comprising: a detergent containing unit for dissolving a detergent by a pressure of said washing water supplied thereto and discharging the dissolved detergent to the washing and dehydrating tub; and a filtering screen unit seated on an upper portion of the detergent containing unit such that it comes into contact with the washing water supplied to the detergent containing unit.

In accordance with the present invention, it is possible to enhance the solubility of detergent and thus improve the washing performance. Since no detergent lump or particulate remains, a damage of clothes due to detergent spoils can be avoided. It is also possible to greatly reduce the environmental contamination and save the amount of consumed detergent.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
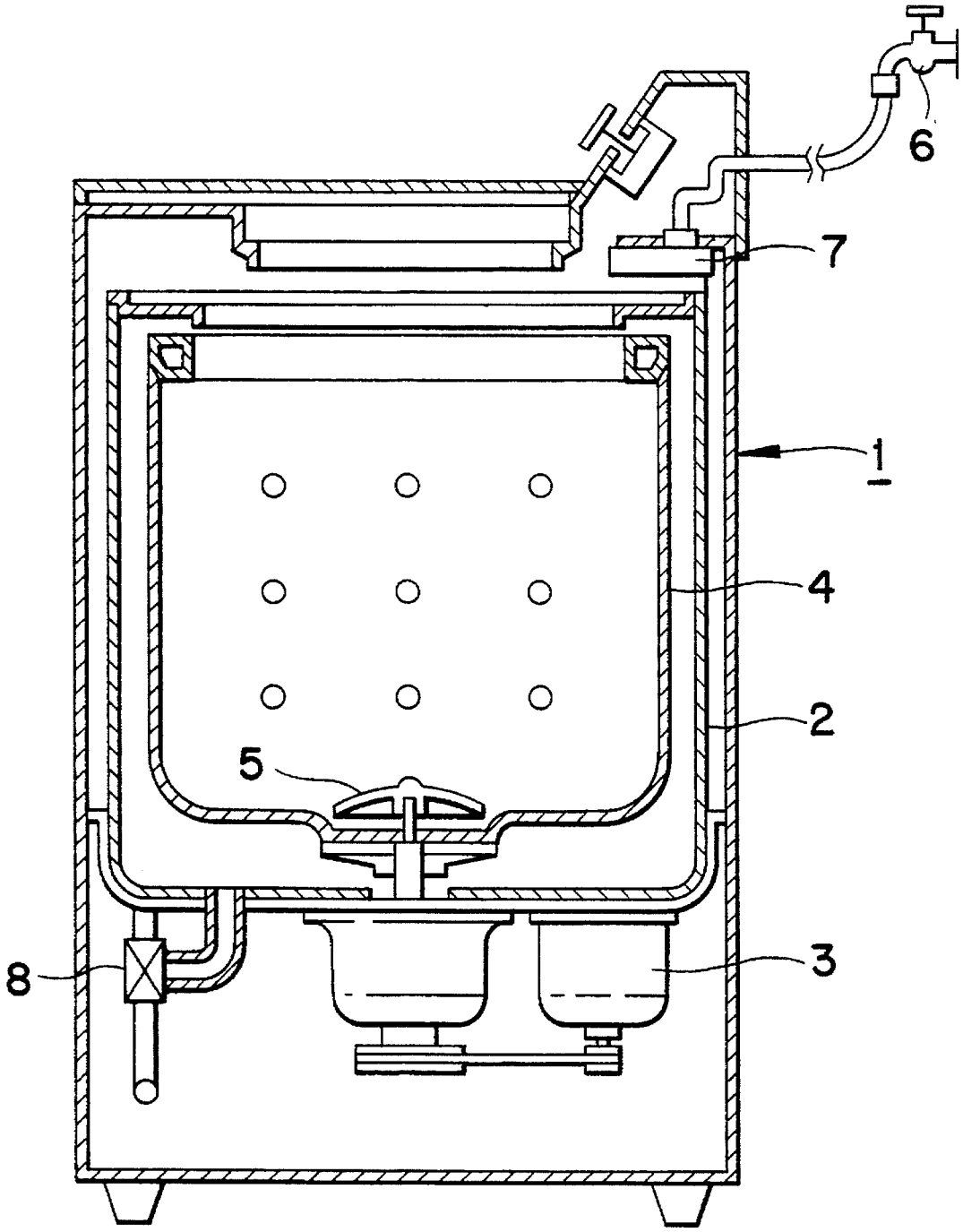
FIG. 1 PRIOR ART
FIG. 1 is a sectional view of the assembled overall construction of a general washer.
Figure 2:
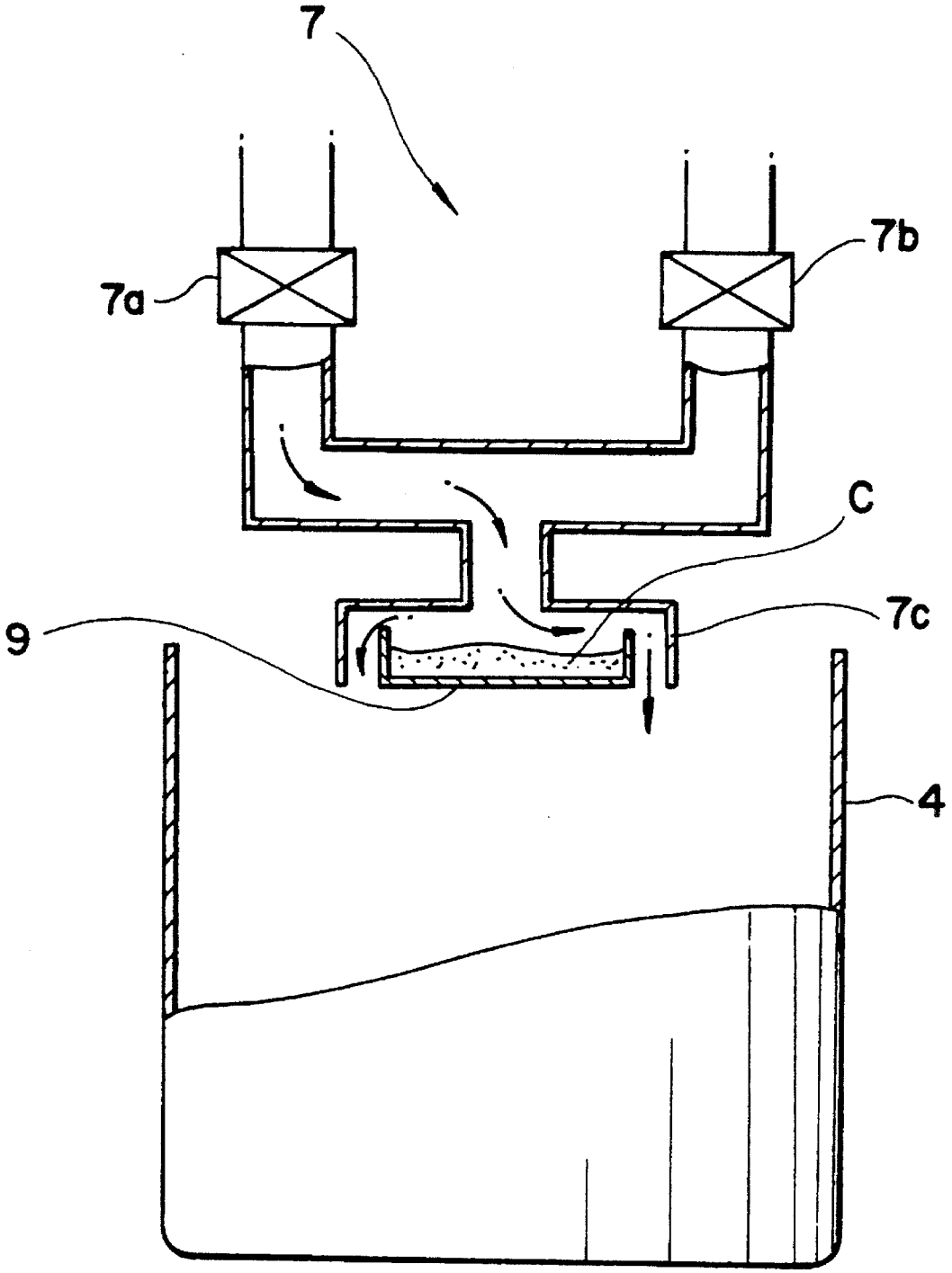
FIG. 2 PRIOR ART
FIG. 2 is a partially broken-out schematic view of a conventional detergent dissolving device employed in general washers.
Figure 3:
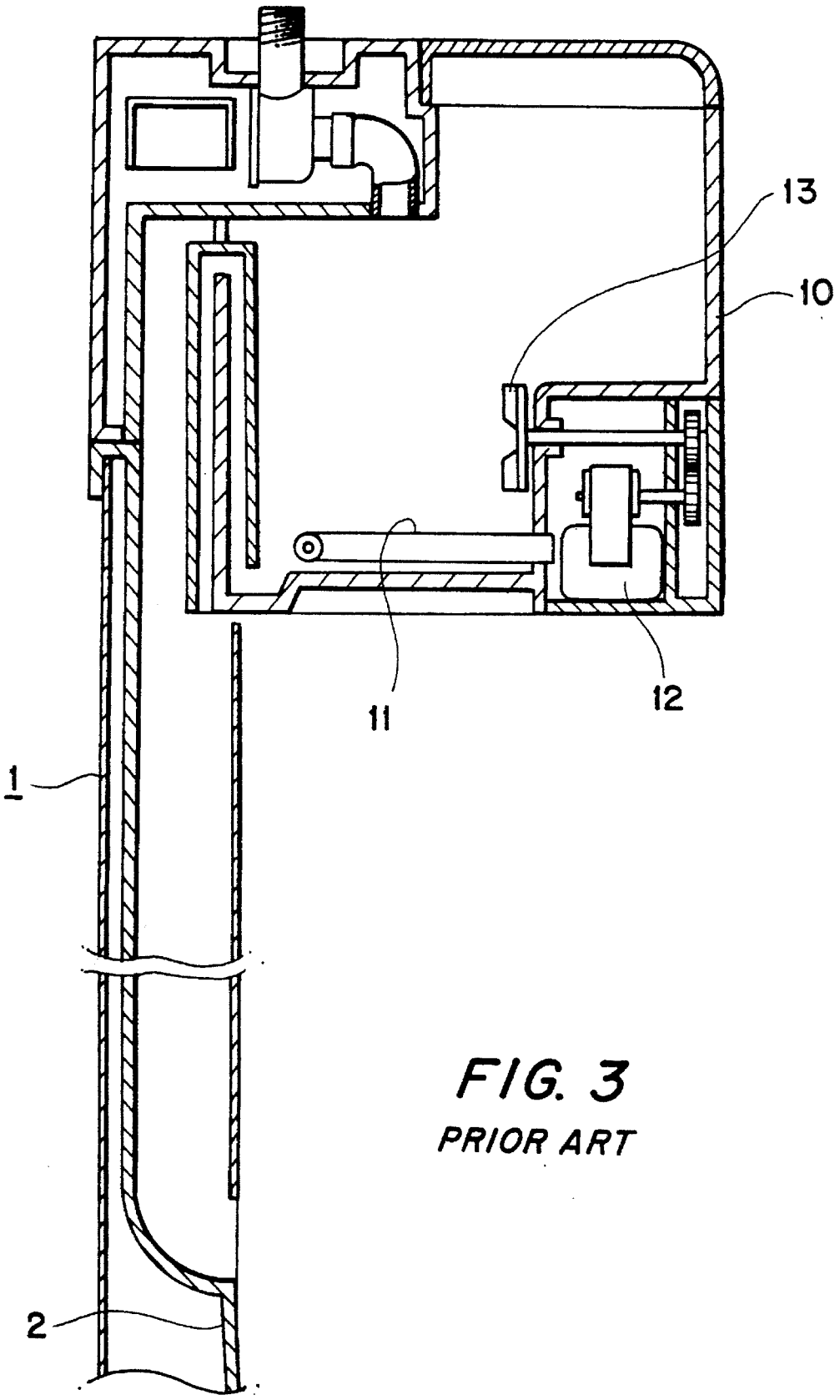
FIG. 3 PRIOR ART
FIG. 3 is a sectional view of another conventional detergent dissolving device.

Referring to FIGS. 4 to 9, there is illustrated a detergent dissolving device in accordance with a first embodiment of the present invention. In FIGS. 4 to 9, the same elements as those of the conventional constructions mentioned hereinbefore are denoted by the same reference numerals and their detailed descriptions are omitted.

As shown in FIGS. 4 to 9, on the upper portion of a washer body, a door 20 is pivotally mounted at its one end, so as to be freely opened and closed. Disposed in front of the door 20 is a manipulation panel 21 for selecting a washing condition.

Figure 4:
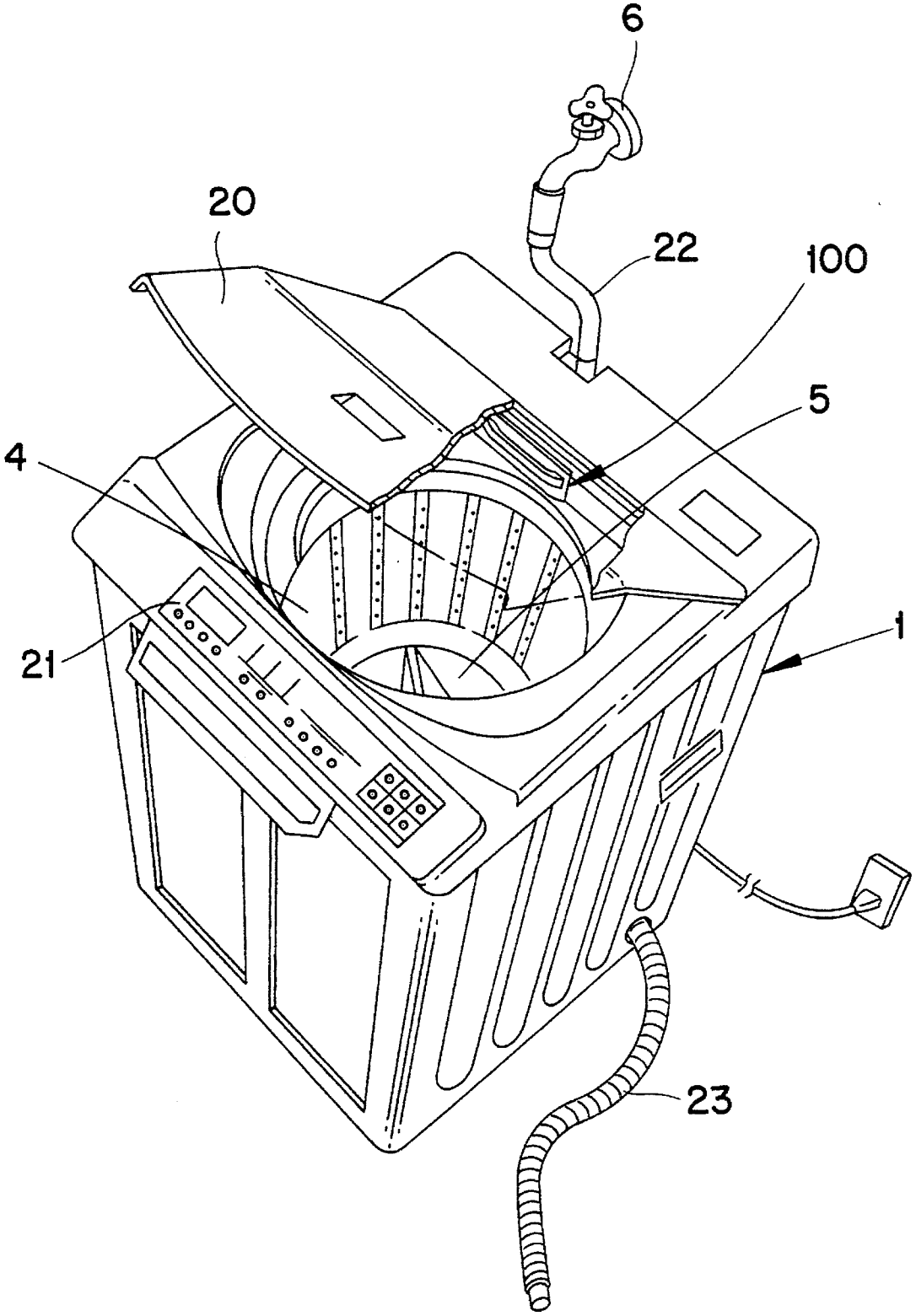
FIG. 4 is a partially broken-out perspective view illustrating the overall construction of a washer to which a detergent dissolving device according to a first embodiment of the present invention is applied.

At the rear portion of the washer body 1, a water supplying hose 22 is mounted, which is connected with a tap 6, so as to supply a washing water in a dehydrating tub 4, as shown in FIG. 4. A drain hose 23 is connected to the washer body 1, at one side portion of the washer body 1. Within the washer body 1, a detergent dissolving device 100 according to the first embodiment of the present invention is provided above the dehydrating tub 4, so as to dissolve a detergent poured in the washer and supply it in the dehydrating tub 4, together with the washing water supplied from the water supplying hose 22.

Figure 5:
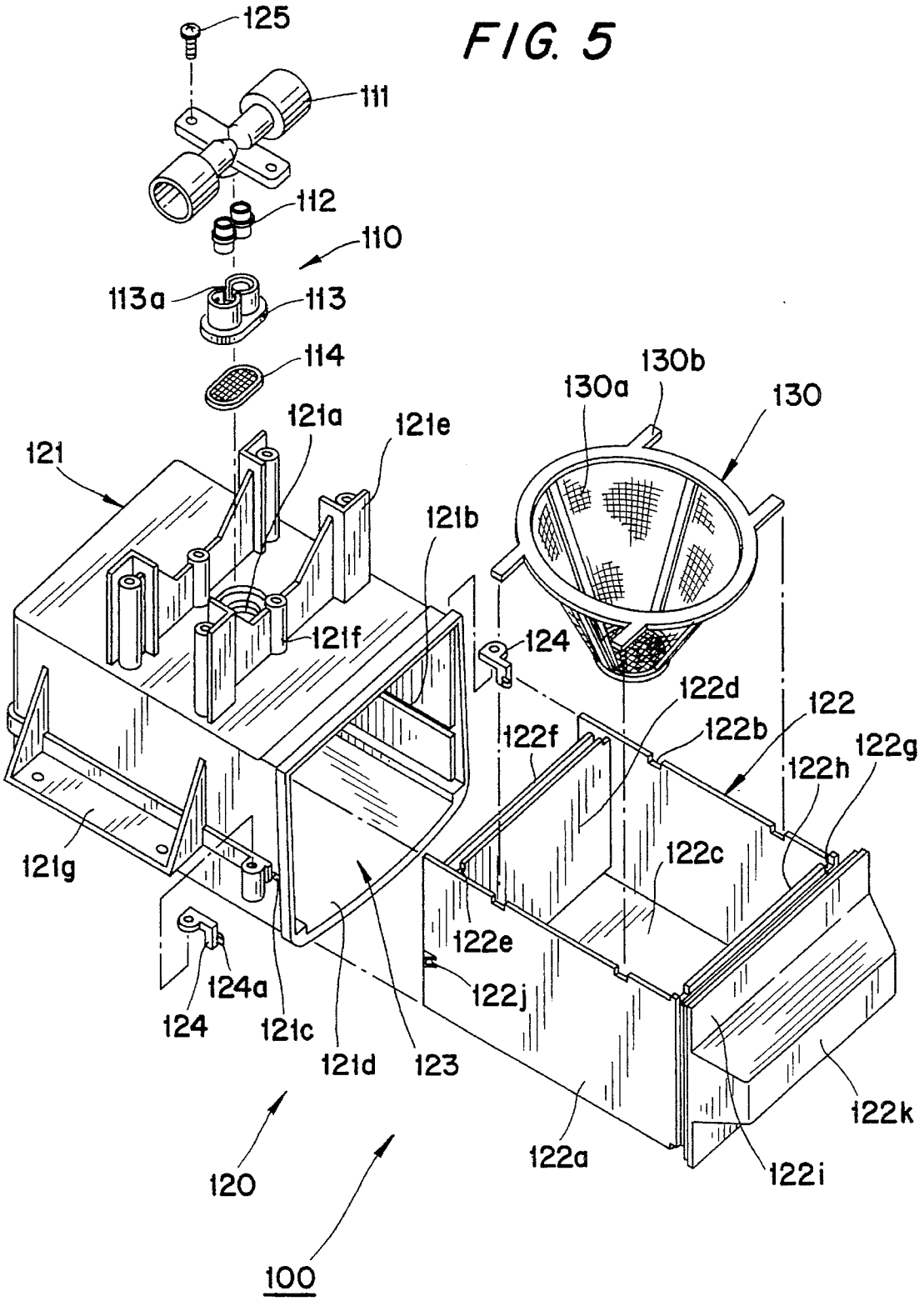
FIG. 5 is an exploded perspective view of the detergent dissolving device according to the first embodiment of the present invention.

As shown in FIG. 5, the detergent dissolving device 100 comprises an acceleration unit 110 for accelerating a flow rate of the washing water supplied from the water supply hose 22 and a detergent containing unit 120 for containing a detergent C therein and dissolving the detergent C by a pressure of the washing water received from the acceleration unit 110 and an oxygen externally supplied.

The detergent containing unit 120 comprises an outer container body 121 fixedly mounted to the washer body 1 and an inner container body 122 slidably fitted in the outer container body 121. The outer container body 121 is provided at its top wall with a water injection port **121*a* to which the acceleration unit 110 is connected. A filtering screen unit 130 is seated on the upper end of the inner container body 122. The filtering screen unit 130 is adapted to completely dissolve the detergent C by the pressure of the washing water received from the acceleration unit 110 and the oxygen externally supplied and supply the completely dissolved detergent C in the dehydrating tub 4**.

Figure 6:
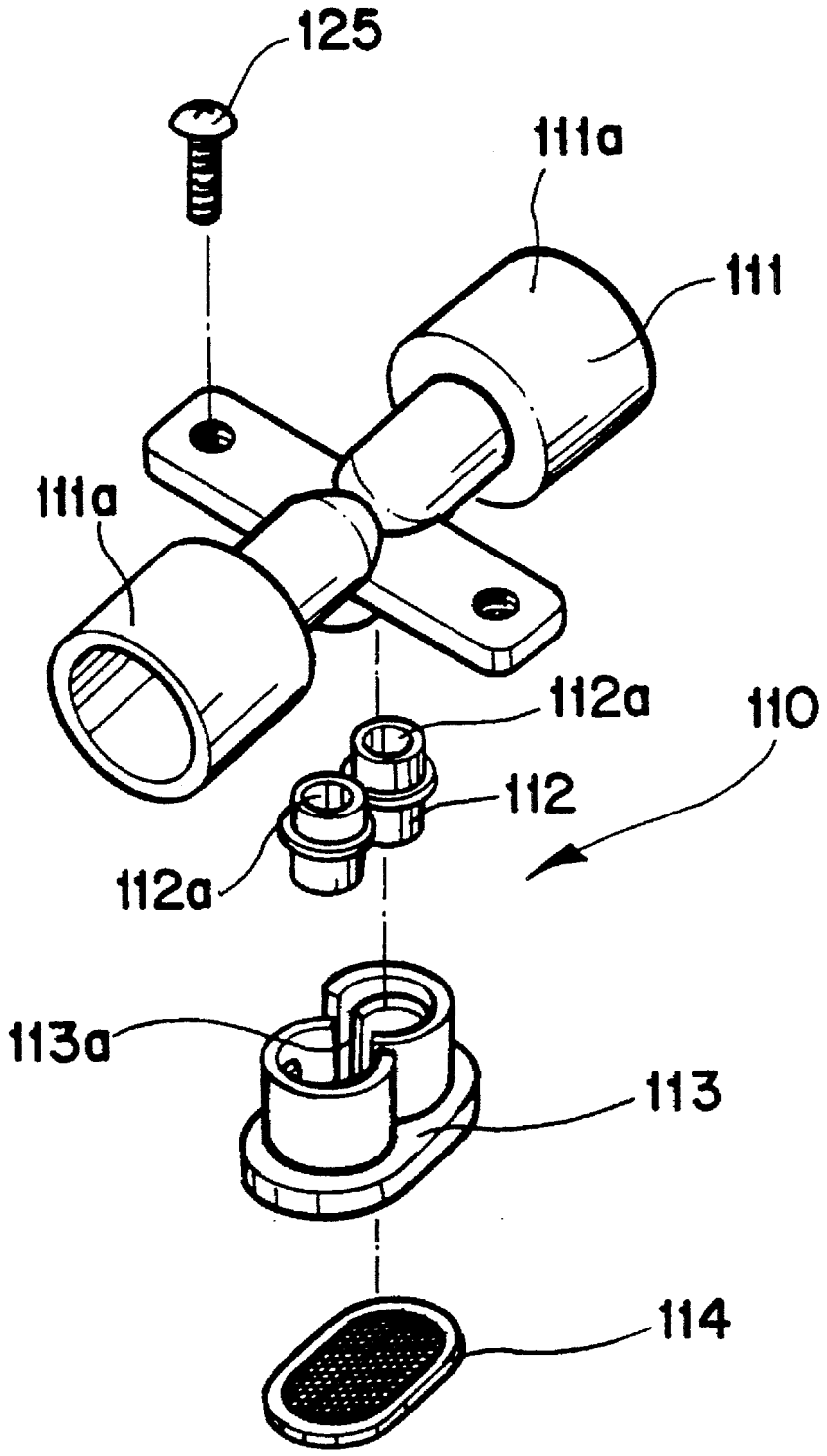
FIG. 6 is an enlarged perspective view of a flow acceleration unit employed in the detergent dissolving device of FIG. 6.

As shown in FIGS. 5 and 6, the acceleration unit 110 includes a connecting pipe 111 having oppositely disposed pipe portions 111A fitted in respective ends of water supplying hoses for a warm water and a cold water, one of which is illustrated as the water supplying hose 22. The acceleration unit 110 also includes an acceleration pipe 112 fitted in the connecting pipe 111 at its upper end. The acceleration pipe 112 has a pair of tapered pipe portions or conduits 112*a* for warm and cold waters. Each tapered pipe portion of the acceleration pipe 112 has an inner diameter gradually reduced toward its lower ends. The acceleration unit 110 also includes an acceleration cap 113 fitted around the lower end of the acceleration pipe 112 at its upper end and provided at one side portion thereof with an air port 113*a* for introducing external air therein.

Between the water injection port 121*a* of the outer container body 121 and the lower surface of the acceleration cap 113, a backwater prevention member 114 is disposed, which is adapted to prevent the washing water that is supplied via the acceleration unit 110 into the inner container body 122, from flowing backwards into the air port 113*a* of the acceleration cap 113 via the water injection port 121*a* upon an initial water supplying. The backwater prevention member 114 has a screen shape at its central portion.

On the other hand, the outer container body 121 has a chamber 123 for receiving the inner container body 122 therein. At the inner surfaces of opposite side walls of the outer container body 121 defining the chamber 123, a pair of guide grooves 121*b* are longitudinally formed, so as to guide smooth slide movements of the inner container body 122 into and out of the chamber 123. At the front of the guide grooves 121*b*, namely, adjacent to an opened end of the outer container body 121, a pair of holes 121*c* are formed at the outer surfaces of opposite side walls of the outer container body 121. In each hole 121*c*, an engaging protrusion 124*a* of an engaging member 124 is inserted, which member will be described, hereinafter.

Figure 7:
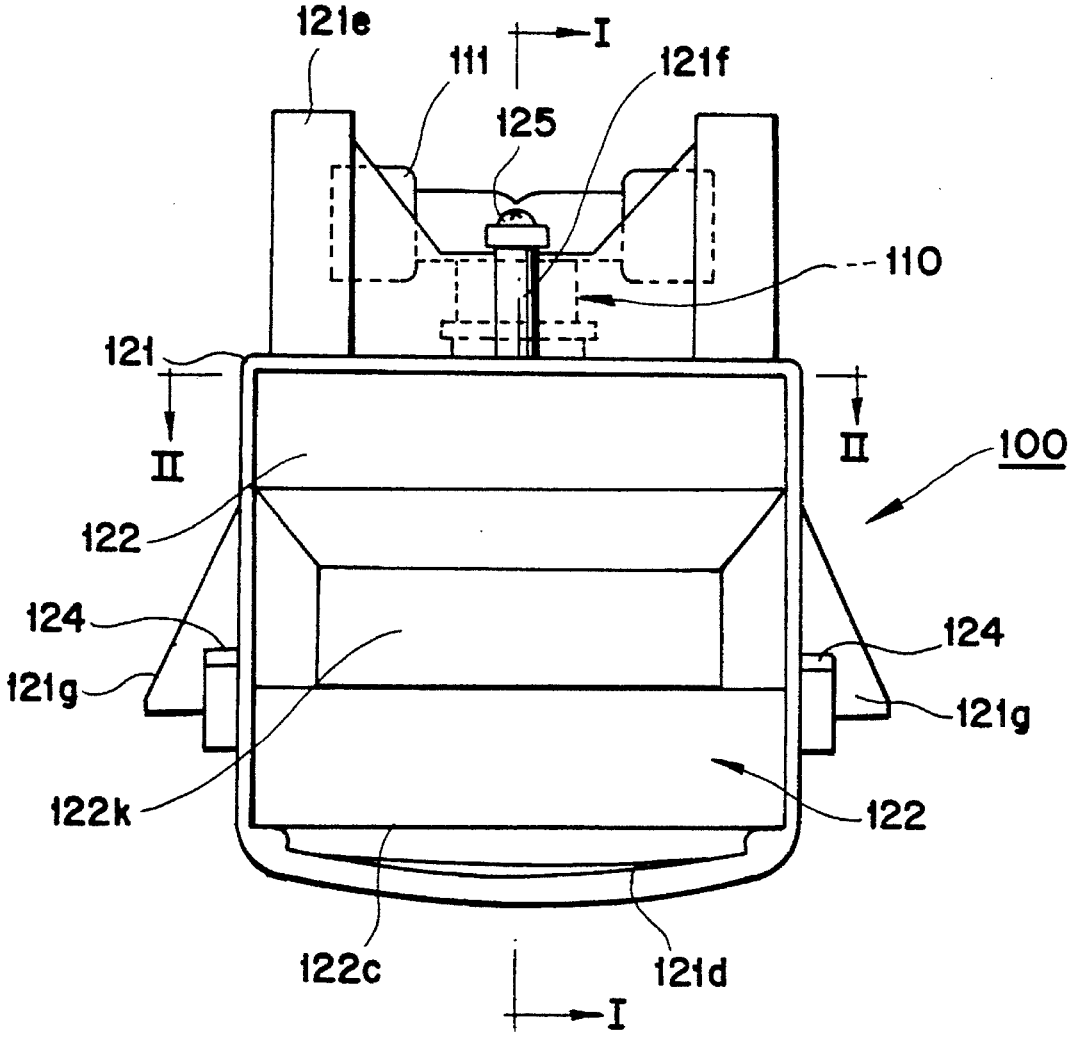
FIG. 7 is a front view of the assembled overall construction of the detergent dissolving device of FIG. 6.
Figure 8:
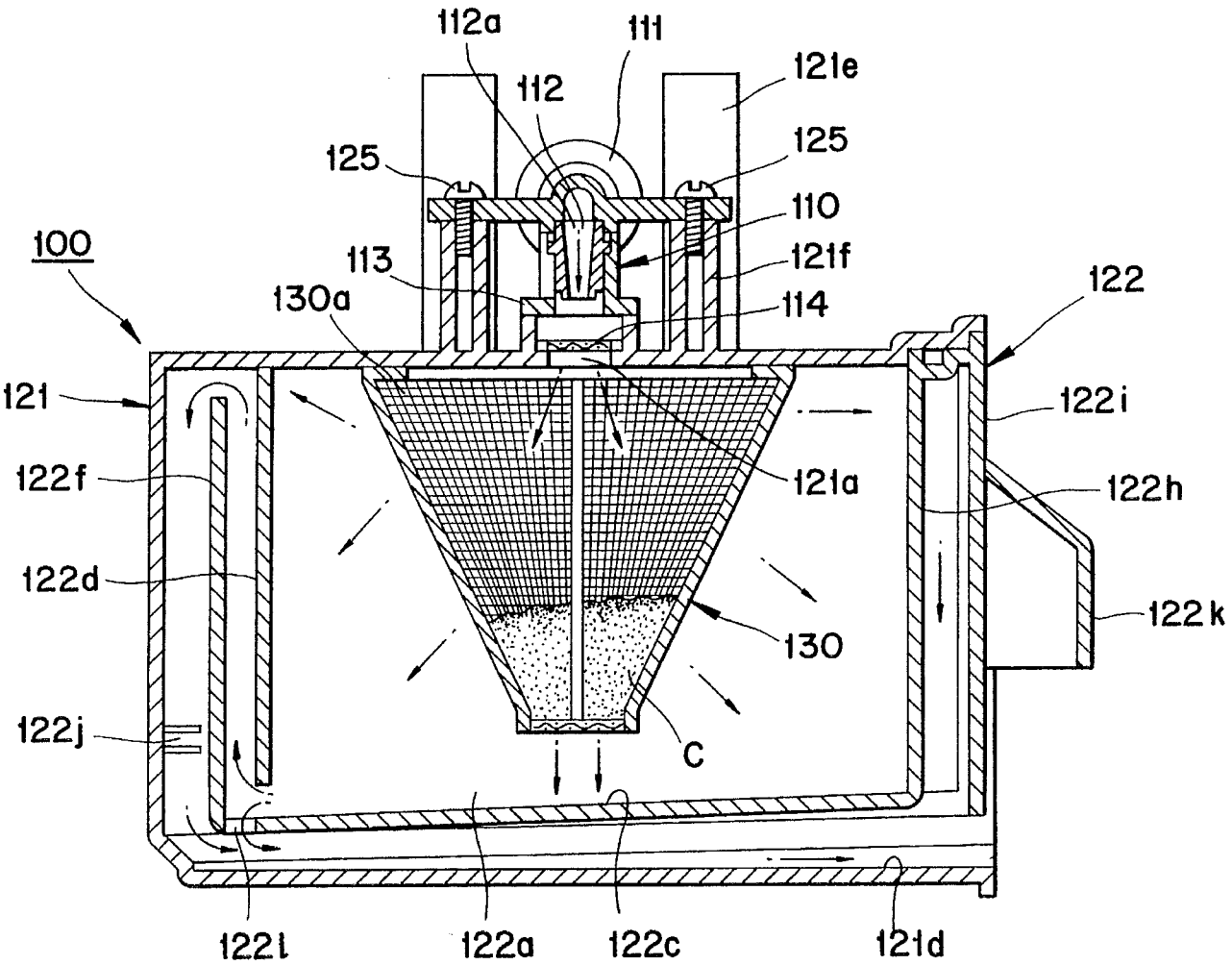
FIG. 8 is a cross-sectional view taken along the line I—I of FIG. 7.
Figure 9:
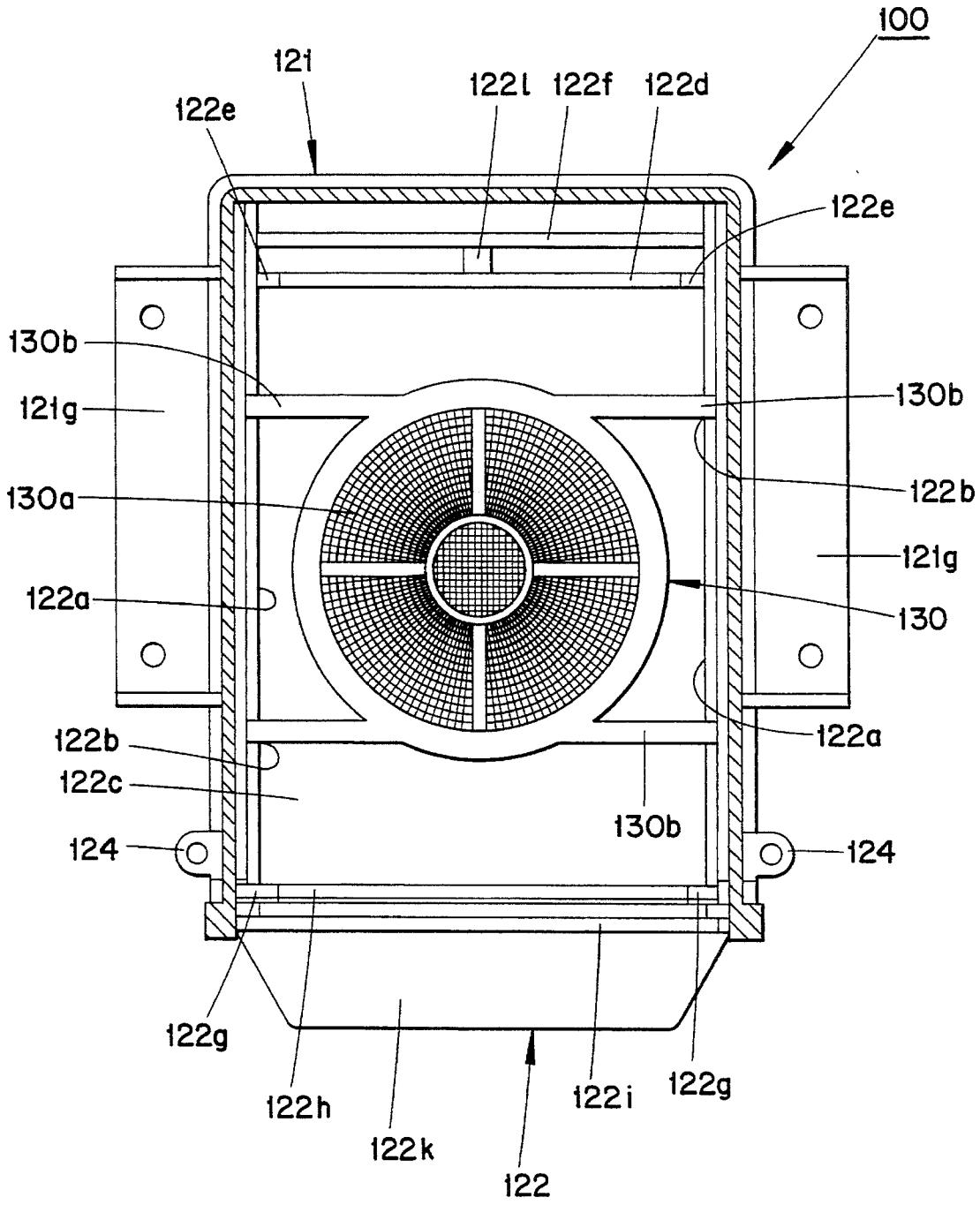
FIG. 9 is a cross-sectional view taken along the line II—II of FIG. 7.

After assembling, the inner container body 122 is inclinedly positioned at its bottom surface in the outer container body 121 such that its rear end is positioned at a level lower than that of its front end, as shown in FIG. 8. To this end, the inner container body 122 has an inclined bottom wall 122*c*. With such a construction, a washing water including a detergent dissolved therein and discharged out of the inner container body 122 is allowed to flow forwardly from the rear end of the outer container body 121. For promoting such flowing, the outer container body 121 also has a bottom surface inclined downwardly toward its front end. The bottom wall 121*d* of the outer container body 121 is arc-shaped so that after assembling with the inner container body 122, the bottom wall is in contact at its opposite lateral ends with the outer bottom surface of the inner container body 122 and defines at its central portion together, with the outer bottom surface of the inner container body 122 a gap serving as a water passage, as shown in FIG. 7.

As shown in FIG. 5, the outer container body 121 has a plurality of support rods 121*e* arranged in front and rear of the water injection port 121*a* and adapted to couple the outer container body 121 to the washer body 1. The support rods 121*e* are upwardly protruded from the top wall of outer container body 121, to be integral with one another. A plurality of support rods 121*f* are also provided at the top wall of outer container body 121. Each support rod 121*f* is arranged between laterally adjacent support rods 121*e* and adapted to couple the connecting pipe 111 of acceleration unit 110 to the outer container body 121 by means of set screws 125.

The outer container body 121 is also provided at its opposite side walls with a pair of outwardly extending support members 121*g* for fixing the opposite side walls to the washer body 1.

On the other hand, the inner container body 122, which is slidably fitted in the chamber 123 of outer container body 121, is provided at the upper ends of its opposite side walls 122*a* with a plurality of seat grooves 122*b* for stably seating the filtering screen unit 130 in the inner container body 122 without any movement even when a pressure of the washing pressure is applied to the filtering screen unit 130. The inner container body 122 also has a first overflow plate 122*d* arranged at the rear portion of inner container body 122. The first overflow plate 122*d* is spaced at its lower end from the bottom wall 122*c* of inner container body 122, so as to define a passage for rearwardly discharging a flow of dissolved detergent out of the interior of inner container body 122, as shown in FIG. 8. At opposite lateral end portions of the upper end of first overflow plate 122*d*, a pair of grooves 122*e* are formed, respectively, which serve to allow an overflow of foams formed in the inner container body 122. At the rear of the first overflow plate 122*d*, a second overflow plate 122*f* is arranged to be spaced a predetermined distance apart from the first overflow plate 122*d*, for defining an upward rear passage for the dissolved detergent flow. The second overflow plate 122*f* is also arranged so that after the assembling between the outer container body 121 and the inner container body 122, it is spaced a predetermined distance apart from the inner rear surface of the outer container body 121, so as to define a downward rear passage for the dissolved detergent flow, as shown in FIG. 8. The second overflow plate 122*f* is also spaced at its upper end from the inner top surface of the outer container body 121, so as to allow an overflow of the dissolved detergent discharged via the first overflow plate 122*d*.

At the front portion of inner container body 122, a third overflow plate 122*h* is mounted, which has a pair of grooves 122*g* at opposite lateral ends of its upper end, so as to allow an overflow of foams formed in the inner container body 122. The third overflow plate 122*h* is arranged to be spaced a predetermined distance apart from a front plate 122*i* as the front wall of inner container body 122. With this arrangement, a pair of downward front passages are defined by the spaces defined at opposite sides of the inner container body 122 between the third overflow plate 122*h* and the front plate 122*i*, respectively.

As shown in FIG. 8, a pair of elastic lugs 122*j* are provided at respective rear portions of opposite side walls 122*a* of the inner container body 122. The elastic lugs 122*j* are engaged in the guide grooves 121*b* of outer container body 121, so as to guide the sliding movement of the inner container body 122 in the outer container body 121. For preventing a separation of the inner container body 122 from the outer container body 121, a pair of engaging members 124 are provided, each of which has the engaging protrusion 124*a* inserted in each hole 121*c* of the outer container body 121. The engaging protrusion 124*a* of each engaging member 124 is engagable with each corresponding elastic lug 122*j* of the inner container body 122, so as to prevent the elastic lug 122*j* from separating from each corresponding guide groove 121*b* of the outer container body 121. At the front plate 122*i*, a handle 122*k* is integrally formed therewith, for allowing the inner container body 122 to be easily taken out of the outer container body 121. A detergent discharge port 122*l* is also provided at the bottom wall 122*c* of inner container body 122 between the first overflow plate 122*d* and the second overflow plate 122*f*.

On the other hand, the filtering screen unit 130 has the funnel shape for easily receiving the detergent C poured therein. The filtering screen unit 130 comprises a dense screen member 130*a* for passing detergent C dissolved by the pressure of the washing water supplied in the filtering screen unit 130 therethrough. At the upper end of screen member 130*a*, a plurality of protrusions 130*b* are formed, which are received in the seat grooves 122*b* formed on the upper ends of opposite side walls 122*a* of the inner container body 122, respectively.

Now, operation of the detergent dissolving device with the above-mentioned construction according to the first embodiment of the present invention will be described.

First, the door 20 pivotally mounted to the top portion of washer body 1 is opened and clothes to be washed are poured in the washing and dehydrating tub 4. Then, the detergent dissolving device 100 is opened and a detergent C is poured in the opened detergent dissolving device 100.

That is, as the inner container body 122 slides forwardly along the outer container body 121, to be opened, the elastic lugs 122*j* on opposite side walls 122*a* of the inner container body 122 guides the slide movement of inner container body 122 while moving along the guide grooves 121*b* formed at opposite inner side surfaces of the outer container body 121. The slide movement of inner container body 122 is continued until the filtering screen unit 130 seated in the inner container body 122 is fully exposed outwardly of the outer container body 121. At this state, the user pours a proper quantity of detergent C in the exposed filtering screen unit 130. After the pouring of detergent C, the user pushes the inner container body 122 into the outer container body 121 and then manipulates water supply means to which the water supplying hose 22 is connected, so that a washing water is supplied in the washer.

Accordingly, the washing water passes through the water supplying hose 22, the connecting pipe 111 and the acceleration unit 110 and then reaches the detergent dissolving device 100. In the detergent dissolving device 100, the washing water applies an impact force against the detergent C contained in the filtering screen unit 130 while passing through the screen member 130*a* of filtering screen unit 130. By the impact force, the detergent C is completely diffused and dissolved in the washing water and then supplied in the interior of inner container body 122.

When the washing water from the connecting pipe 111 passes through the acceleration unit 110, it is subjected to a variation in flow and a pressure difference generated upon the dropping of washing water, since the acceleration pipe 112 has the tapered shape having the inner diameter gradually reduced toward its lower end. In particular, the flow rate of the washing water becomes accelerated as air in the atmosphere, namely, oxygen is introduced in the acceleration cap 113 via the air port 113*a* formed at the acceleration cap 113. Such an introduction of atmospheric air, in particular, oxygen is achieved in that the internal pressure of the acceleration unit 110 is lower than the atmospheric pressure. By virtue of such an acceleration of washing water, the solution of the detergent C received in the filtering screen unit 130 is more enhanced. The washing water discharged out of the acceleration unit 110 is radially diffused in the filtering screen unit 130 toward the interior of inner container body 122 in a short time, by a washing water pressure established by the above-mentioned acceleration. As a result, a vortex flow of washing water occurs in the filtering screen unit 130. These procedures are continuously repeated for the overall water supplying time, so that the detergent C contained in the filtering screen unit 130 can be finely mixed and dissolved in the washing water, thereby forming foams.

The formed foams come up to the surface of washing water in the inner container body 122 and then overflow rapidly the inner container body 122 through grooves 122*g* and 122*e* respectively formed on the first and third overflow plate 122*h* and 122*d* at the front and rear portions of inner container body 122.

At this time, the foams overflowing through the grooves 122*g* of the third overflow plate 122*h* pass through the passages defined by the spaces between the third overflow plate 122*h* and the front plate 122*i* and then enter a front portion of the bottom passage defined by the outer bottom surface of inner container member 122 and the arc portion 121*d* of outer container member 121, so that they are introduced in the dehydrating tub 4. On the other hand, the foams overflowing through the grooves 122*e* pass over the upper end of second overflow plate 122*f* and then flows downwardly along the downward rear passage defined between the second overflow plate 122*f* and the rear wall of outer container body 121. The foams from the downward rear passage are then introduced in the inclined bottom passage defined between the bottom wall 122*c* of inner container body 122 and the arc portion 121*d* of outer container body 121. The foams flow along the inclined bottom passage and then enter the dehydrating tub 4.

A part of the detergent C dissolved in the washing water is continuously discharged out of the inner container body 122 through the detergent discharge port 122*l* formed at the bottom wall 122*c* of inner container body 122 by virtue of the velocity of the dropping washing water supplied in the inner container body 122. The detergent part is then introduced in the inclined bottom passage, so that it flows along the downward rear passage and then enters the dehydrating tub 4. On the other hand, a large part of the detergent C passes the passage defined between the lower end of first overflow plate 122*d* and the bottom wall 122*c* of inner container body 122 and enters the upward rear passage defined between the first overflow plate 122*d* and the second overflow plate 122*f*. Thereafter, the large detergent part flows upwardly along the upward rear passage and then overflows the upper end of second overflow plate 122*f*, so that it enters and flows downwardly along the downward rear passage defined between the second overflow plate 122*f* and the rear wall of outer container body 121.

Together with the washing water, the large detergent part from the downward rear passage is then introduced in the inclined bottom passage defined between the bottom wall 122*c* of inner container body 122 and the arc portion 121*d* of outer container body 121. The washing water including the dissolved detergent flows along the inclined bottom passage and then enters the dehydrating tub 4.

Together with the washing water and the clothes, the dissolved detergent C supplied in the dehydrating tub 4 is subjected to normal and reverse rotations of the pulsator 5, so that a vortex flow of washing water is generated, thereby enabling the clothes to be washed.

As apparent from the above description, the detergent is completely dissolved in the washing water by the pressure of the washing water according to the first embodiment of the present invention. Also, the foams occurring during the solution of detergent are rapidly supplied in the dehydrating tub. The first embodiment also provides a convenience in use in that the inner container body is slidably moved along the outer container body, for its opening and closing. As the completely dissolved detergent is supplied, it is possible to greatly reduce environmental contamination such as water quality contamination. In addition, it is also possible to avoid clothes from being spoiled by the detergent.

Figure 10:
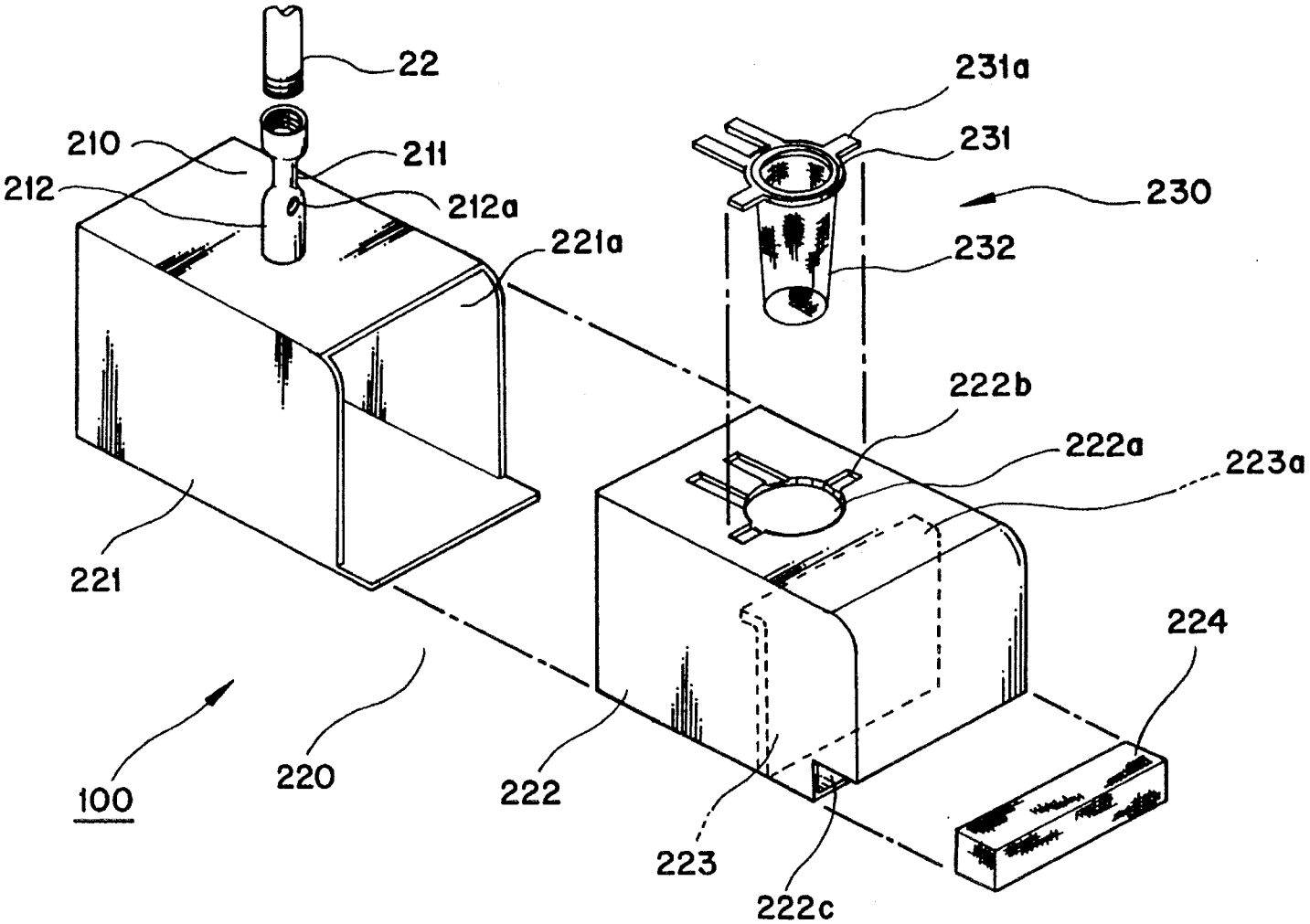
FIG. 10 is an exploded perspective view of a detergent dissolving device according to a second embodiment of the present invention.
Figure 11:
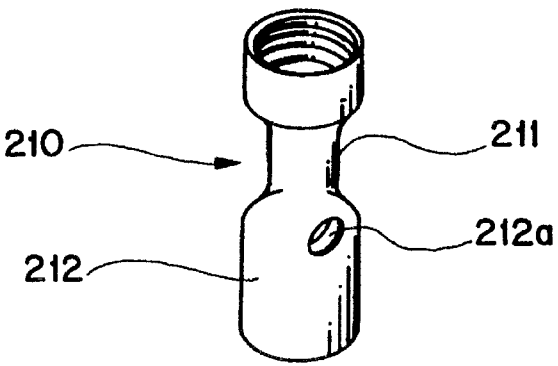
FIG. 11 is a perspective view of an acceleration unit employed in the detergent dissolving device of FIG. 10.
Figure 12:
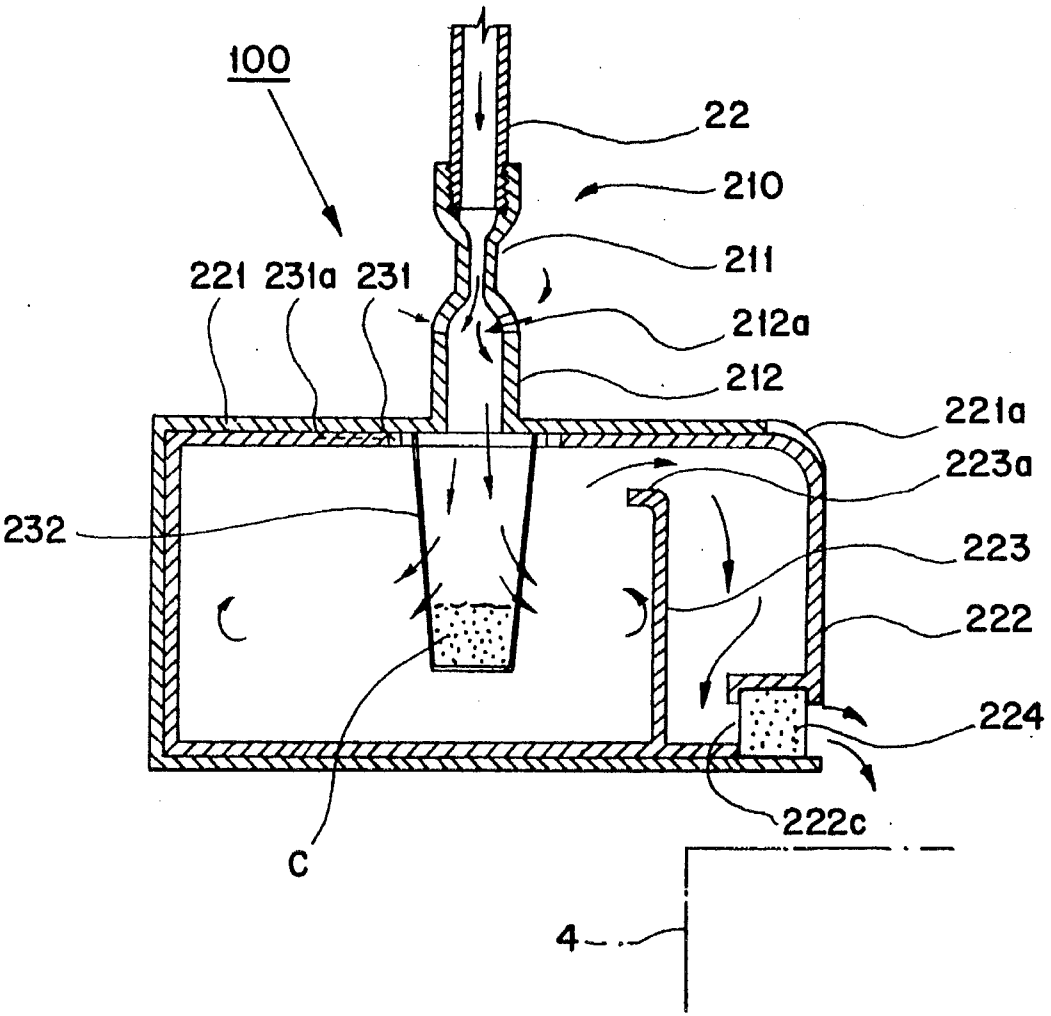
FIG. 12 is a sectional view of the assembled overall construction of the detergent dissolving device of FIG. 10.

Referring to FIGS. 10 to 12, there is illustrated a detergent dissolving device according to a second embodiment of the present invention.

FIG. 10 is art exploded perspective view of the detergent dissolving device of the second embodiment. FIG. 11 is a perspective view of an acceleration unit employed in the detergent dissolving device. FIG. 12 is a sectional view of the assembled overall construction of the detergent dissolving device. In FIGS. 10 to 12, the same elements as those of FIGS. 4 to 9 are denoted by the same reference numerals. In accordance with the second embodiment, the detergent dissolving device which is denoted by the reference numeral 100 comprises an acceleration unit 210 connected to the water supply hose 22 and adapted to accelerate a flow rate of washing water supplied from the water supply hose 22 and a detergent containing unit 220 for containing a detergent C therein and dissolving the detergent C by a pressure of the washing water received from the acceleration unit 210.

As shown in FIG. 10 and 12, the detergent containing unit 220 comprises an outer container body 221 connected at its top wall with the acceleration unit 210 and an inner container body 222 slidably fitted in the outer container body 221. A filtering screen unit 230 in which the detergent C is received is seated at its upper portion on the top wall of the inner container body 222 and received at its remaining portion in the inner container body 222.

The acceleration unit 210 includes a small diameter portion 211 and a large diameter portion 212 having a diameter larger than that of the small diameter portion 211, as shown in FIG. 11. The large diameter portion 212 of acceleration unit 210 is provided at its upper portion with a plurality of circumferentially arranged air ports 212*a* for introducing external air in the acceleration unit 210.

As shown in FIGS. 10, the outer container body 221 has an opening 221*a* at one side thereof. Through the opening 221*a*, the inner container body 222 is slidably received in the outer container body 221. The inner container body 222 is provided at its upper wall with a hole 222*a* for receiving a main part of the filtering screen unit 230.

Around the hole 222*a*, a plurality of seat grooves 222*b* for stably seating the filtering screen unit 230 are formed on the top wall of the inner container body 222. In the inner container body 222, an overflow plate 223 is mounted, which is adapted to allow the washing water to overflow when the level of washing water in the inner container body 222 exceeds a predetermined level.

A discharge port 222*c* is formed at the bottom end of the front wall of inner container body 222, so as to discharge the washing water out of the inner container body 222. In the discharge port 222*c*, a filter member 224 is separably fitted, which serves to filter detergent C contained in the washing water, but not dissolved.

It is preferred that the overflow plate 223 has at its upper end a bent portion 223*a* for generating a vortex flow of the washing water introduced in the inner container body 222.

The filtering screen unit 230 which is received in the container body 222 through the hole 222*a* comprises a ring member 231 having at its circumferential surface a plurality of protrusions 231 each seated in each corresponding seat groove 222*b* of the inner container body 222, and a screen member 232 connected at its upper end to the ring member 231 and adapted to pass a proper quantity of detergent C therethrough.

The screen member 232 is comprised of a stainless screen material having a mesh size of 20 to 100 meshes for allowing only detergent C dissolved in a state of fine particulates to pass therethrough.

For assembling the detergent dissolving device with the above-mentioned construction according to the second embodiment, first, a threaded end of the water supplying hose 22 is threadedly coupled to a threaded end of the acceleration unit 210 fixed to the top wall of the outer container body 221. Thereafter, the filtering screen unit 230 is inserted into the inner container body 222 through the hole 222*a* formed at the top wall of inner container body 222. At this time, the protrusions 231*a* of ring member 231 is received in the seat grooves 222*b* of inner container body 222 so that the ring member 231 and thus the filtering screen unit 230 are stably seated on the top wall of inner container body 222. The filter member 224 is then fitted in the discharge port 222*c* of inner container body 222. In the filtering screen unit 230, a proper amount of detergent C is poured. Under this condition, the inner container body 222 is inserted into the outer container body 221 through the opening 221*a*.

When the inner container body 222 is completely received in the outer container body 221, the acceleration unit 210 is vertically aligned with the filtering screen unit 230, namely, the ring member 231 and the screen member 232. As a washing water is supplied through the water supplying hose 22, according to a selection of means not shown, it passes through the acceleration unit 210. A flow of washing water is accelerated by the acceleration unit 210 and then introduced in the filtering screen unit 230.

In the acceleration unit 210, the washing water increases in flow rate as it is discharged out of the small diameter portion 211 toward the large diameter portion 212. Such an increase in flow rate occurs due to a pressure difference generated between the small diameter portion 211 and the large diameter portion 212. At this time, external air is introduced in the large diameter portion 212 through the air ports 212*a* and entrained in the washing water entering the large diameter portion 212. Accordingly, the washing water including air, namely, oxygen is discharged out of the acceleration unit 210 and then introduced in the filtering screen unit 230.

The oxygen-entraining washing water applies a strong impact force against the detergent C in the filtering screen unit 230 while entering the filtering screen unit 230 at a high velocity, so that the detergent C is rapidly dissolved. The washing water from the filtering screen unit 230 then enters the inner container body 222 and forms a vortex flow therein. By this vortex flow, the detergent C introduced in the inner container body 222 through the filtering screen unit 230 and having a phase of incompletely dissolved fine particulates is completely dissolved and then supplied in the dehydrating tub 4 through the discharge port 222*c*.

That is, the washing water introduced in the inner container body 222 forms a vortex flow according to a function of the bent portion 223*a* of the overflow plate 223 disposed in the inner container body 222, so that a solution of the detergent C is promoted in the inner container body 222. The washing water including the completely dissolved detergent C then overflows the bent portion 223*a* of overflow plate 223 and is discharged out of the inner container body 222 through the discharge port 222*c*. At this time, the detergent C entrained in the washing water, but not dissolved yet is filtered by the filter member 224. This detergent C is supplied in the dehydrating tub 4 after being dissolved in the washing water.

The formation of the vortex flow in the inner container body 222 is promoted by the shape of the bent portion 223*a* provided at the upper end of overflow plate 223, so that the solution of the detergent C discharged out of the filtering screen unit 230 is more rapidly achieved.

Since the screen member 232 is comprised of a stainless screen material having a mesh size of 20 to 100 meshes, it does not allow poorly dissolved detergent lumps to pass therethrough. It is also possible to use the screen member 232 semi-permanently, in that the screen member 232 is not oxidized by the washing water coming into contact therewith.

As apparent from the above description, in the detergent dissolving device of the second embodiment, the solution of detergent can be rapidly achieved by the washing water accelerated by the above-mentioned simple construction. Also, fine detergent particulates incompletely dissolved are completely dissolved by a vortex flow of washing water formed in the inner container body. As the completely dissolved detergent is supplied, a washing performance can be improved. It is also possible to greatly reduce the environmental contamination and obtain clean clothes free of spoils after washing. There is also an advantage of a saying of consumed detergent, in that a proper amount of detergent can be used.

Next, a detergent dissolving device according to a third embodiment of the present invention will be described, in conjunction with FIGS. 13 to 16. In FIGS. 13 to 16, the same elements as those of FIGS. 4 to 9 are denoted by the same reference numerals.

Figure 13:
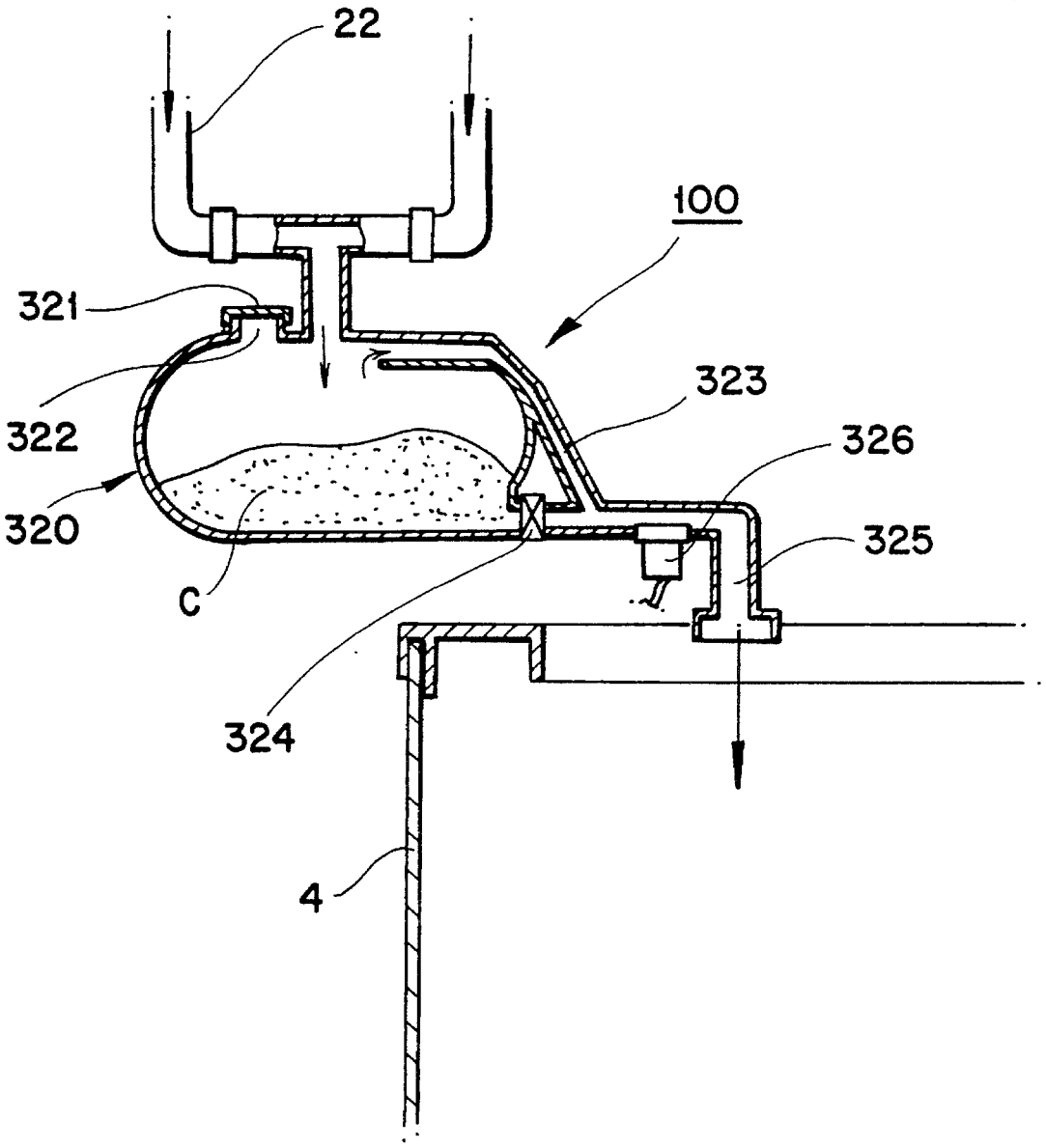
FIG. 13 is a sectional view of the assembled overall construction of a detergent dissolving device according to a third embodiment of the present invention.

FIG. 13 is a sectional view of the assembled overall construction of the detergent dissolving device according to the third embodiment. In accordance with the third embodiment, the detergent dissolving device which is denoted by the reference numeral 100 comprises an acceleration unit 310 connected at its upper end to the water supply hose 22 and a detergent containing unit 320 for containing a detergent C, as shown in FIG. 13.

The detergent containing unit 320 has at its top portion a pouring port 322 through which a detergent C can be poured in the detergent containing unit 320. The pouring port 322 can be opened and closed by a lid 321 pivotally mounted on the top portion of detergent containing unit 320. The detergent containing unit 320 also has an overflow pipe 323 integrally formed with one side portion of the detergent containing unit 320 and adapted to allow an overflow of a washing water contained in the detergent containing unit 320 to be discharged out of the detergent containing unit 320. The detergent containing unit 320 is also provided at its lower portion with a discharge pipe 325 integrally formed with the detergent containing unit 320 and adapted to discharge the washing water contained in the detergent containing unit 320 toward the dehydrating tub 4. A valve 324 is disposed in the discharge pipe 325, for controlling a flow of washing water through the discharge pipe 325. Downstream of the valve 324, the discharge pipe 325 is communicated with the overflow pipe 323 so that the washing water overflowing through the overflow pipe 323 can be discharged through the discharge pipe 325.

In the discharge pipe 325, an ultrasonic oscillator 326 is mounted for generating a vibration in the discharge pipe 325 and thus enhancing a solubility of the detergent C.

Upon washing, first, a predetermined amount of detergent C is poured in the detergent containing unit 320 through the pouring port 322 which is opened by separating the lid 321 therefrom. As a desired washing condition is then selected, a washing water is supplied in the detergent containing unit 320 through the water supplying hose 22. At this time, the detergent C contained in the detergent containing unit 320 is easily dissolved in the supplied washing water.

At this time, the valve 324 is maintained at its closed state. Accordingly, the washing water continuously supplied in the detergent containing unit 320 rises in level in the detergent containing unit 320 while dissolving the detergent C. As the washing water including the dissolved detergent C reaches the overflow pipe 323, it is discharged through the overflow pipe 323 and the discharge pipe 325 and then introduced in the dehydrating tub 4.

During the above operation, the ultrasonic oscillator 326 emits ultrasonic waves at the discharge pipe 325, according to an operation of an ultrasonic oscillating circuit not shown. By the ultrasonic waves, the remaining detergent powder which has not been dissolved in the detergent containing unit 320 yet is dissolved.

That is, when the detergent C which has been subjected to a primary dissolving treatment in the detergent receiver unit 320 passes through the discharge pipe 325, together with the washing water, the ultrasonic waves emitted from the ultrasonic oscillator 326 serve to secondarily dissolve fine detergent particulates in the washing water. As a result, only the completely dissolved detergent liquid is supplied in the dehydrating tub 4.

The supplying of the washing water serving to dissolve the detergent C is continued until the detergent C contained in the detergent containing unit 320 is completely poured in the dehydrating tub 4. Thereafter, a normal supplying of washing water for the washing is carried out, as the valve 324 is opened according to a control signal from control means not shown.

Figure 14:
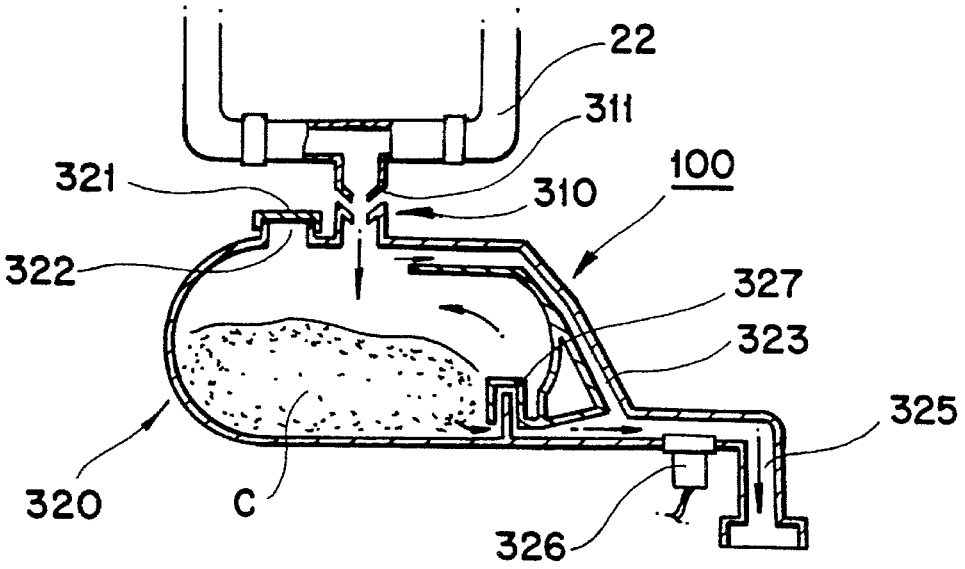
FIG. 14 is a sectional view of the detergent dissolving device of FIG. 13, viewed in a direction different from that of FIG. 13.
Figure 15:
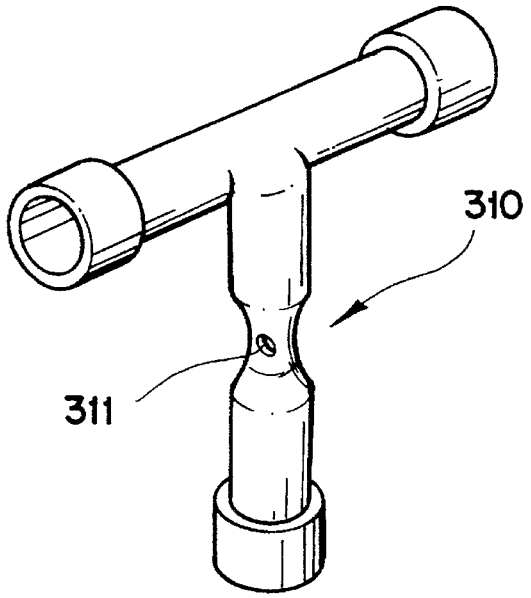
FIG. 15 is an enlarged perspective view of an acceleration unit employed in the detergent dissolving device of FIG. 13.
Figure 16:
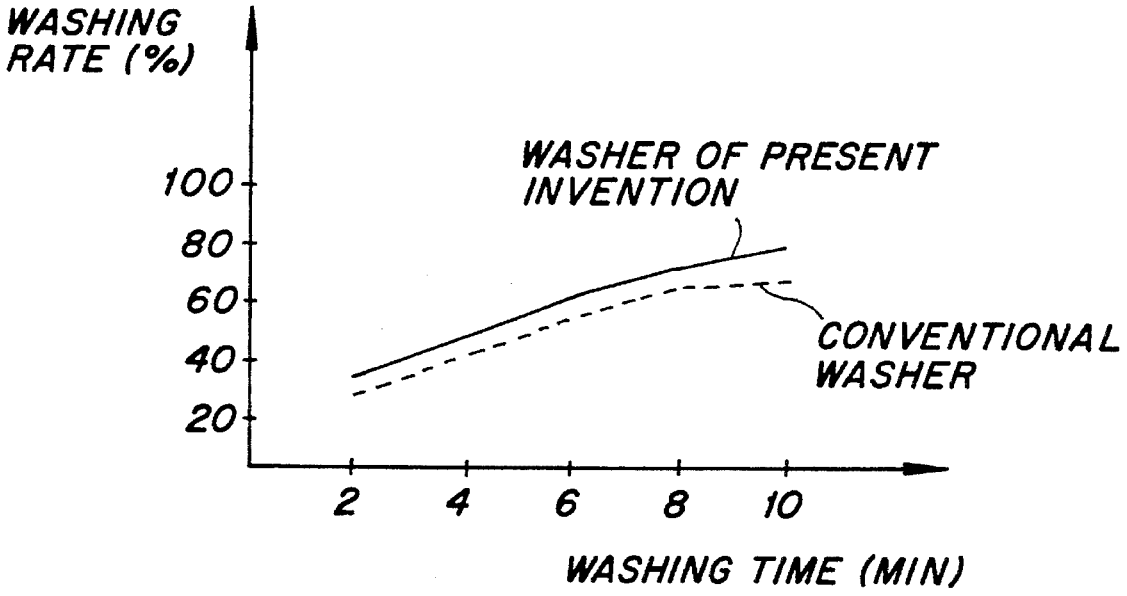
FIG. 16 is a graph for comparing washing rates of a washer employing the detergent dissolving device of the present invention and a general washer employing a conventional detergent dissolving device.

In accordance with this embodiment, the acceleration unit 310 which is connected with the water supplying hose 22 above the detergent containing unit 320 has a plurality of downwardly inclined air ports 311 adapted to increase a flow rate of the supplied washing water, as shown in FIGS. 14 and 15. Also, a syphon pipe 327 is disposed between the detergent containing unit 320 and the discharge pipe 327, as shown in FIG. 14. By the provisions of the air ports 311 and the syphon pipe 327, it is possible not only to increase the solubility of the detergent C contained in the detergent containing unit 320 by the accelerated washing water, but also to more easily supply the dissolved detergent C in the dehydrating tub 4 via the syphon pipe 327 and the overflow pipe 323.

Figure 18:
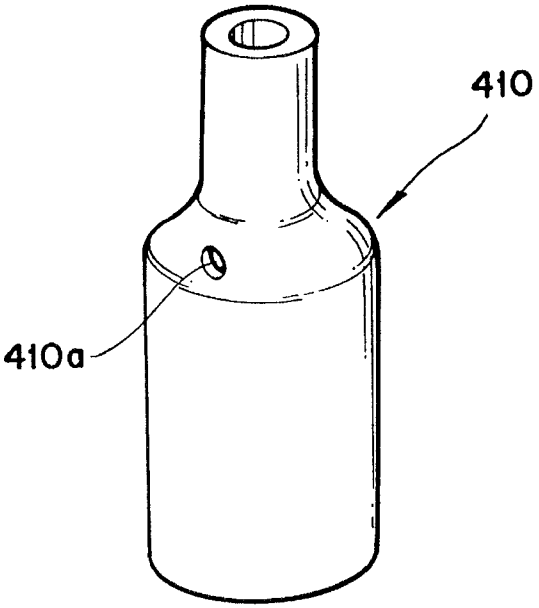
FIG. 18 is an enlarged view of an acceleration unit employed in the detergent dissolving device of FIG. 17.

By referring to FIG. 18, it can be found that an improved washability can be obtained in this embodiment, as compared with conventional washers.

As apparent from the above description, the detergent dissolving device of the third embodiment supplies the completely dissolved detergent in the dehydrating tub, by primarily dissolving detergent powder by the pressure of washing water in the detergent containing unit and then secondarily dissolving the remaining detergent particulates contained in the washing water by the ultrasonic waves. As the completely dissolved detergent is supplied, a washing efficiency can be improved. It is also possible to greatly reduce the environmental contamination and obtain clean clothes free of spoils after washing. There is also an advantage of a saving of consumed detergent.

Figure 17:
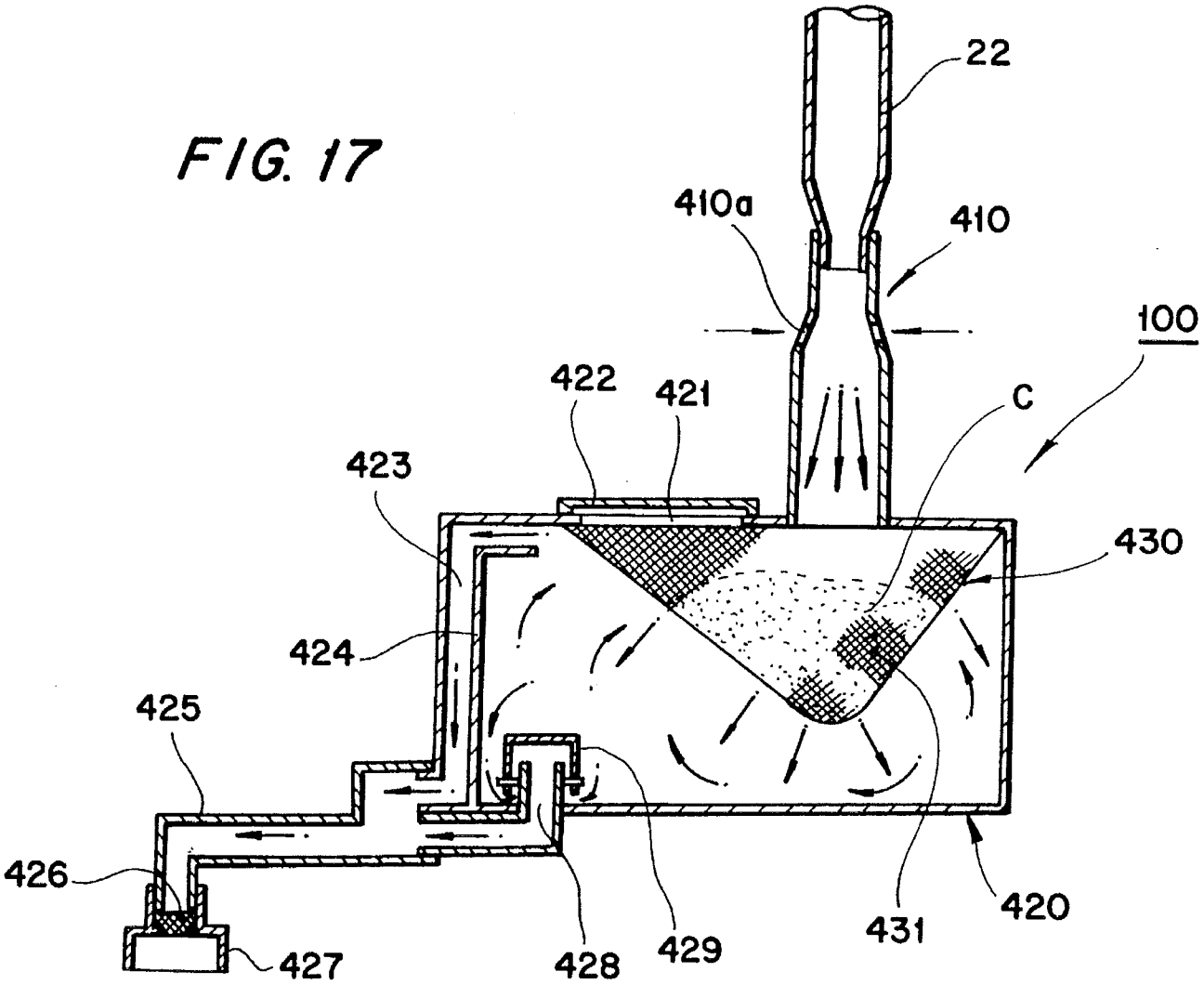
FIG. 17 is a sectional view of the assembled overall construction of a detergent dissolving device according to the fourth embodiment of the present invention.

Next, a detergent dissolving device according to a fourth embodiment of the present invention will be described, in conjunction with FIGS. 17 and 18. In FIGS. 17 and 18, the same elements as those of FIGS. 4 to 9 are denoted by the same reference numerals.

FIG. 17 is a sectional view of the assembled overall construction of the detergent dissolving device according to the fourth embodiment. FIG. 18 is an enlarged view of an acceleration unit employed in the detergent dissolving device according to the fourth embodiment.

In accordance with the fourth embodiment, the detergent dissolving device which is denoted by the reference numeral 100 comprises an acceleration unit 410 for accelerating a flow rate of a washing water supplied and a detergent containing unit 420 for dissolving a detergent C contained therein by using the pressure of the washing water received from the acceleration unit 410 and discharging the dissolved detergent C toward the dehydrating tub 4, as shown in FIG. 17.

The detergent dissolving device 100 also comprises a filtering screen unit 430 coupled at its upper end to the top portion of detergent containing unit 420. The filtering screen unit 430 includes a funnel-shaped screen member 431 which constitutes the lower portion of filtering screen unit 430.

As shown in FIG. 18, the acceleration unit 410 is provided at its middle circumferential portion with a plurality of air ports 410*a* for allowing external air to be introduced in the acceleration unit 410 when the washing water is fed to the acceleration unit 410. The acceleration unit 410 is connected at its upper end with the water supplying hose 22.

The detergent containing unit 420 has at its top portion a pouring port 421 through which a detergent C can be poured in the detergent containing unit 420. The pouring port 421 can be opened and closed by a lid 422 separably mounted on the top portion of detergent containing unit 420.

In the detergent containing unit 420, an overflow plate 424 is vertically mounted to be spaced from one side portion of the detergent containing unit 420 such that a passage 423 is defined therebetween. To the one side portion of the detergent containing unit 420, a discharge pipe 425 is mounted, which communicates with the passage 423 and extends outwardly. A discharge member 427 having a filter member 426 fitted therein is coupled to the outer end of discharge pipe 425.

A syphon pipe 428 is connected at one end thereof to the inner end of discharge pipe 425 at which the discharge pipe 425 communicates with the passage 423. The syphon pipe 428 is adapted to discharge washing water including the detergent C dissolved therein toward the discharge pipe 425. The syphon pipe 425 is capped with a cap member 429 at the other end disposed in the interior of detergent containing unit 420. A gap is defined between the cap member 429 and the other end of syphon pipe 425, so that the washing water in the detergent containing unit 420 can be introduced in the syphon pipe 425 through the gap.

Operation of the detergent dissolving device with the above-mentioned construction will now be described.

Upon washing, first, a predetermined amount of detergent C is poured in the screen member 431 of filtering screen unit 430 through the pouring port 421 which is opened by separating the lid 422 therefrom. Thereafter, as a washing water is supplied in the detergent dissolving device 100 through the water supplying hose 22, it passes through the acceleration unit 410. In the acceleration unit 410, a flow of washing water is accelerated by external air introduced in the acceleration unit 410 through the air ports 410*a*. Accordingly, the washing water is fed at an accelerated rate to the filtering screen unit 430.

At this time, oxygen included in the introduced air is entrained in the washing water passing through the acceleration unit 410. The oxygen serves to enhance the solution of detergent C in the washing water. The accelerated washing water applies an impact force against the detergent C contained in the screen member 431 by its pressure upon the dropping of washing water, thereby improving the solubility of the detergent C.

Similar to the first and second embodiments, the washing water including the dissolved detergent C discharged out of the filtering screen unit 430 forms a vortex flow in the detergent containing unit 420. By the formed vortex flow, a part of the washing water overflows the overflow plate 424, so that it is discharged toward the discharge pipe 425 via the passage 423. The remaining part of washing water is introduced in the interior of cap member 429 and then discharged toward the discharge pipe 425 via the syphon pipe 428. The washing water passing through the discharge pipe 425 is filtered by the filter member 426 disposed at the discharge member 427 so that it becomes free of fine detergent particulates not dissolved yet. Thereafter, the washing water from the discharge member 427 is supplied in the dehydrating tub 4.

As apparent from the above description, in the detergent dissolving device of the fourth embodiment, a proper amount of detergent is poured in the filtering screen unit. Also, atmospheric air is introduced in the detergent containing unit, by virtue of a variation in pressure of the washing water supplied. Accordingly, it is possible to finely and completely dissolve the detergent in the washing water. As the completely dissolved detergent is supplied, together with the washing water, there is no undissolved detergent. As a result, it is possible to reduce the number of clothes rinsing times, greatly reduce the environmental contamination, reduce the washing time, and improve the washing performance.

Figure 19:
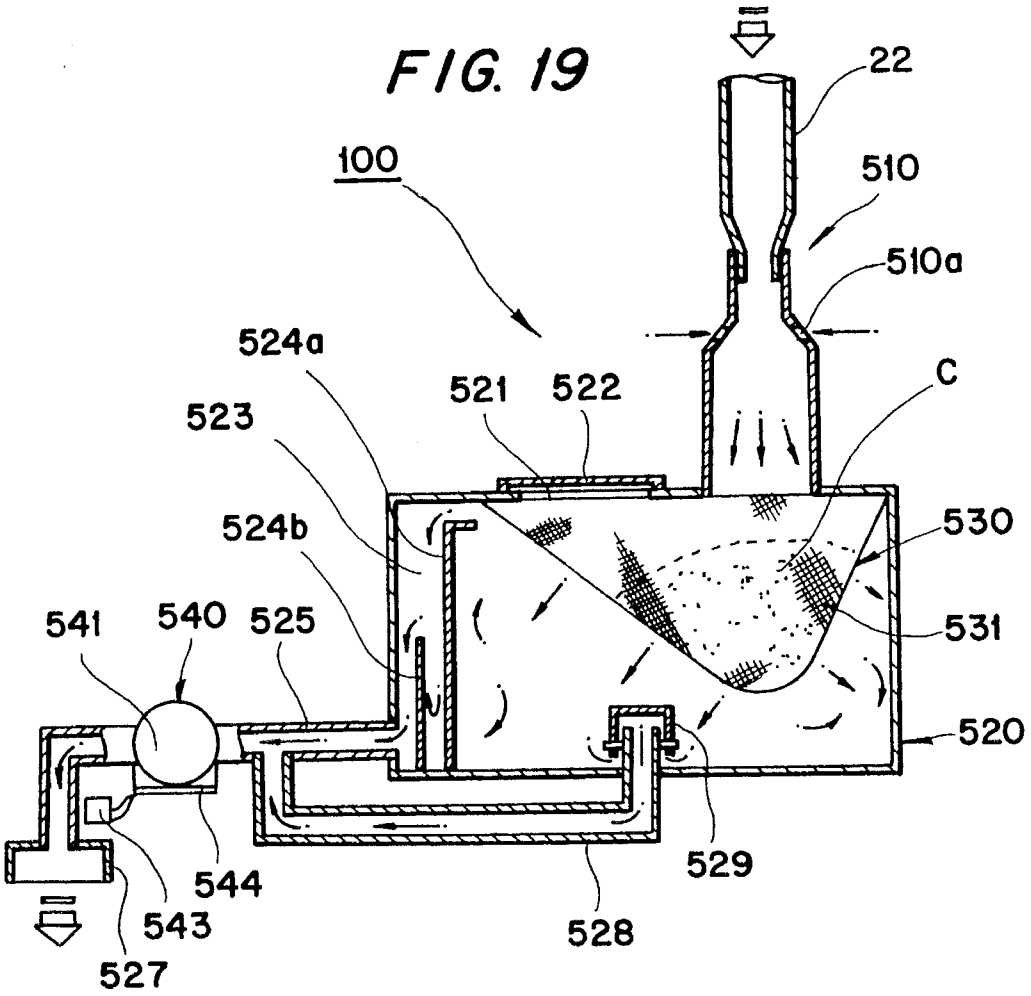
FIG. 19 is a sectional view of the assembled overall construction of a detergent dissolving device according to a fifth embodiment of the present invention.
Figure 20:
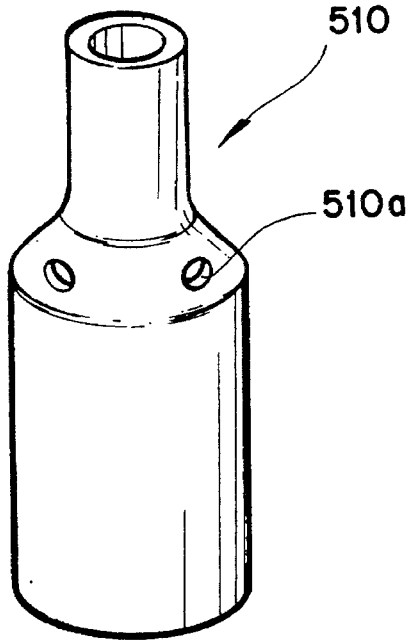
FIG. 20 is a perspective view of an acceleration unit employed in the detergent dissolving device of FIG. 19.
Figure 21:
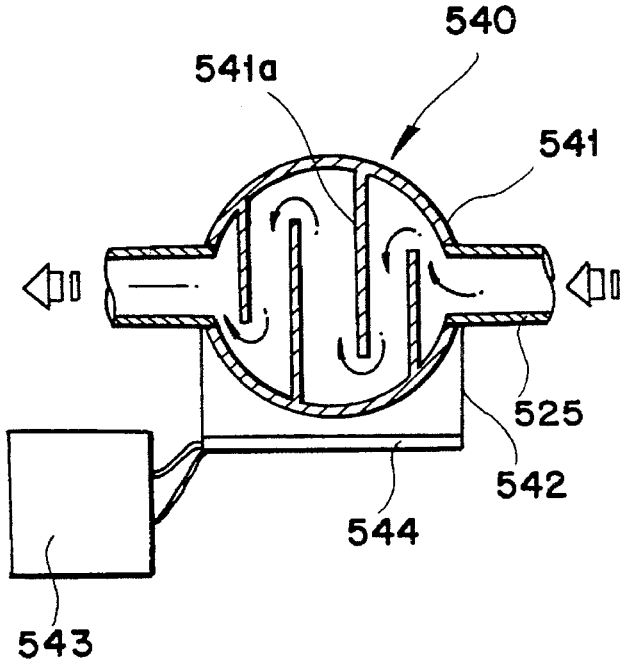
FIG. 21 is an enlarged sectional view of an oscillating unit employed in the detergent dissolving device of FIG. 19.

Referring to FIGS. 19 to 21, there is illustrated a detergent dissolving device in accordance with a fifth embodiment of the present invention.

FIG. 19 is a sectional view of the assembled overall construction of the detergent dissolving device according to the fifth embodiment. FIG. 20 is a perspective view of an acceleration unit employed in the detergent dissolving device according to the fifth embodiment. FIG. 21 is an enlarged sectional view of an oscillating unit employed in the detergent dissolving device according to the fifth embodiment.

In accordance with the fifth embodiment, the detergent dissolving device which is denoted by the reference numeral 100 comprises an acceleration unit 510 for accelerating a flow rate of a washing water supplied and a detergent containing unit 520 for dissolving a detergent C contained therein by using the pressure of the washing water received from the acceleration unit 510 and discharging the dissolved detergent C toward the dehydrating tub 4.

The detergent dissolving device 100 also comprises a filtering screen unit 530 coupled at its upper end to the top portion of detergent containing unit 520. The filtering screen unit 530 includes a funnel-shaped screen member 531 which constitutes the lower portion of filtering screen unit 530.

As shown in FIG. 20, the acceleration unit 510 is provided at its middle circumferential portion with a plurality of air ports 510*a* for allowing external air to be introduced in the acceleration unit 510 when the washing water is fed to the acceleration unit 510. The acceleration unit 510 is connected at its upper end with the water supplying hose 22.

The detergent containing unit 520 has at its top portion a pouring port 521 through which a detergent C can be poured in the detergent containing unit 520. The pouring port 521 can be opened and closed by a lid 522 separably mounted on the top portion of detergent containing unit 520.

In the detergent containing unit 520, a pair of spaced overflow plate 524*a* and 524*b* are vertically mounted to be spaced from one side portion of the detergent containing unit 520, so as to form a passage 523. To the one side portion of the detergent containing unit 520, a discharge pipe 525 is mounted, which communicates with the passage 523 and extends outwardly. An oscillating unit 540 is disposed in the discharge pipe 540. The oscillating unit 540 is adapted to apply vibrations to the washing water passing through the discharge pipe 525 so that even fine detergent particulates which have passed through the screen member 531 can be completely dissolved. The oscillating unit 540 also serves to reduce the flow velocity of washing water. A discharge member 527 is coupled to the outer end of discharge pipe 525.

A syphon pipe 528 is connected at one end thereof to the inner end of discharge pipe 525 at which the discharge pipe 525 communicates with the passage 523. The syphon pipe 528 is adapted to discharge washing water including the detergent C dissolved therein toward the discharge pipe 525. The syphon pipe 525 is capped with a cap member 529 at the other end disposed in the interior of detergent containing unit 520. A gap is defined between the cap member 529 and the other end of syphon pipe 525, so that the washing water in the detergent containing unit 520 can be introduced in the syphon pipe 525 through the gap.

The oscillating unit 540 comprises a spherical body 541 communicating at its opposite side portions with portions of the discharge pipe 525 and a plurality of guide plates 541*a* alternatingly arranged in the spherical body 541 and adapted to guide a flow of washing water in the spherical body 541. The oscillating unit 540 also comprises an oscillating circuit 543 and an oscillator 544 mounted on a bracket 542 fixed to the lower portion of spherical body 541 and adapted to generate vibrations according to an operation of the oscillating circuit 543.

Operation of the detergent dissolving device with the above-mentioned construction will now be described.

Upon washing, first, a washing water from the water supplying hose 22 is supplied in the acceleration unit 510. At this time, external air is introduced in the acceleration unit 510 through the air ports 510*a*, so that the flow velocity of washing water increases in the acceleration unit 510. The accelerated washing water applies an impact force against the detergent C contained in the screen member 531 while passing through the screen member 531. As a result, the solution of detergent C can be more rapidly carried out.

Thereafter, the detergent C dissolved in the washing water by the impact force of washing water passes through the screen member 531 and then enters the detergent containing unit 520, together with the washing water. At this time, the washing water forms a vortex flow in the detergent containing unit 520 so that the detergent C not dissolved yet can be more finely dissolved. A part of the washing water including the detergent dissolved therein is then discharged toward the discharge pipe 525 along the passage 523 defined by the first and second overflow plates 524*a* and 524*b*. On the other hand, the remaining part of washing water is introduced in the interior of cap member 529 disposed at the lower portion of detergent containing unit 520 and then discharged toward the discharge pipe 525 via the syphon pipe 528.

The washing water introduced in the discharge pipe 425 then passes through the spherical body 541. As the washing water passes through the spherical body 541, it is subjected to vibrations generated from the oscillator 544 according to the operation of oscillating circuit 543, so that even fine detergent particulates can be dissolved in the washing water. Also, the flow velocity of washing water is sufficiently reduced in the spherical body 541. The washing water is then discharged out of the discharge pipe 525 toward the dehydrating tub 4 via the discharge member 527.

As apparent from the above description, in the detergent dissolving device of the fourth embodiment, the solution of detergent is achieved by the impact force of accelerated washing water. Also, fine detergent particulates incompletely dissolved are completely dissolved by transmitting vibrations from the vibrating unit to the washing water. Accordingly, the amount of consumed detergent can be considerably reduced. It is also possible to greatly reduce the environmental contamination and improve the washability.

Figure 22:
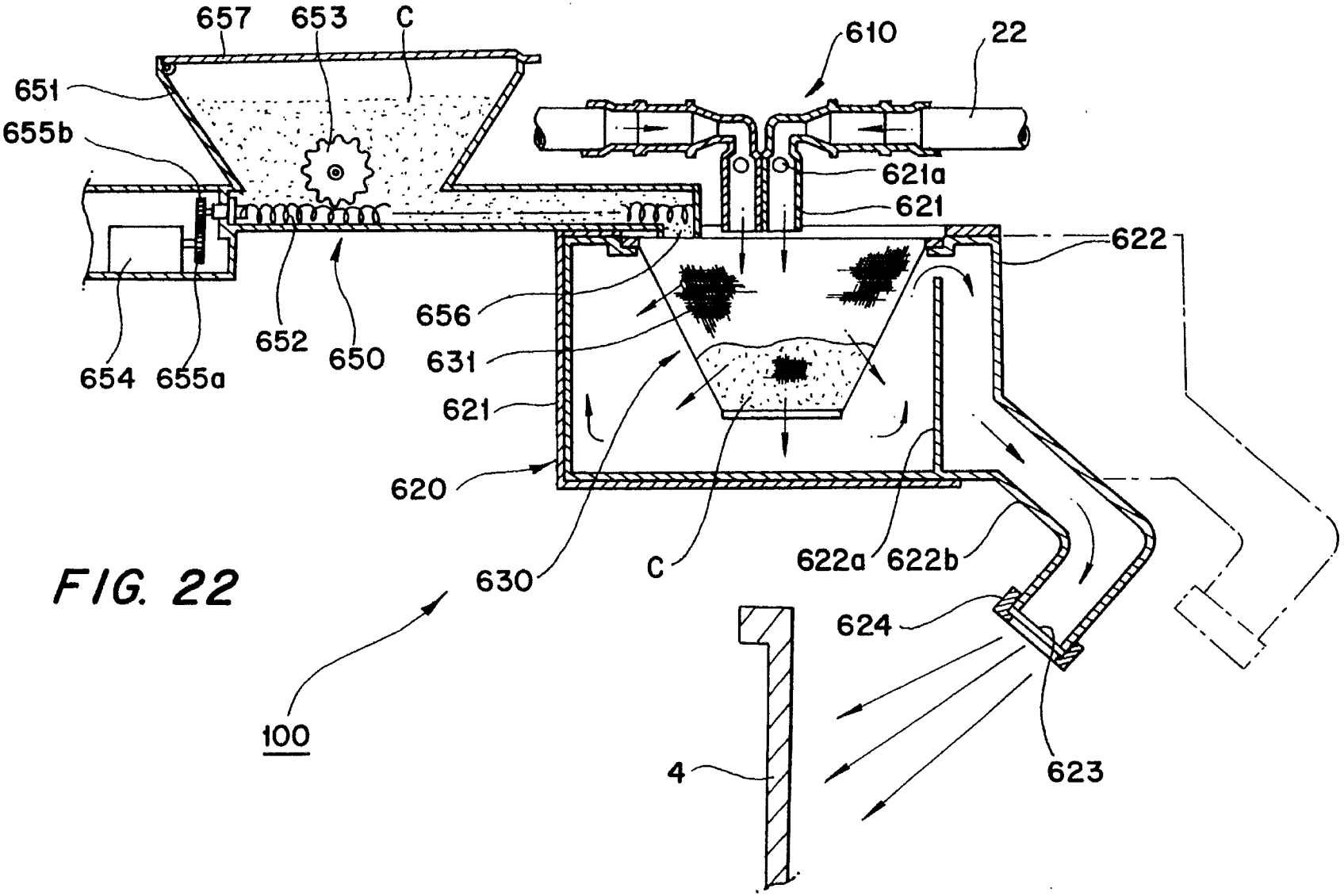
FIG. 22 is a sectional view of the assembled overall construction of a detergent dissolving device according to a sixth embodiment of the present invention.
Figure 23:
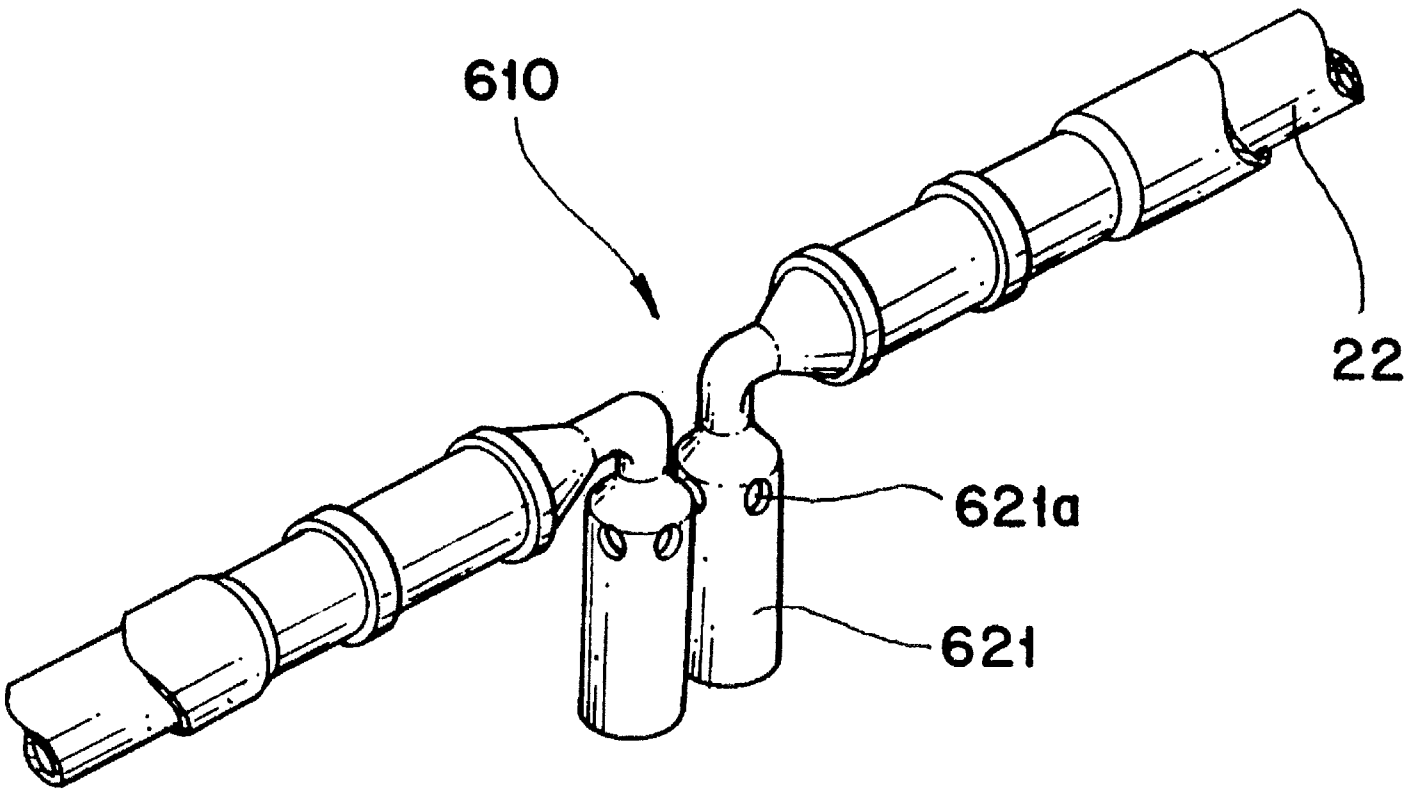
FIG. 23 is a perspective view of an acceleration unit employed in the detergent dissolving device of FIG. 22.

Finally, a detergent dissolving device according to a sixth embodiment of the present invention will be described, in conjunction with FIGS. 22 and 23. In FIGS. 22 and 23, the same elements as those of FIGS. 4 to 9 are denoted by the same reference numerals.

FIG. 22 is a sectional view of the assembled overall construction of the detergent dissolving device according to the sixth embodiment. FIG. 23 is a perspective view of an acceleration unit employed in the detergent dissolving device according to the sixth embodiment. In accordance with the sixth embodiment, the detergent dissolving device which is denoted by the reference numeral 100 comprises an acceleration unit 610 for accelerating a flow rate of a washing water supplied and a detergent containing unit 620 for dissolving a detergent C contained therein by using the pressure of the washing water received from the acceleration unit 610, and a filtering screen unit 630 coupled at its upper end to the top portion of detergent containing unit 620 and adapted to contain the detergent C therein.

As shown in FIG. 22, the detergent dissolving device 100 also comprises a detergent supplying unit 650 for storing the detergent C and supplying it to the filtering screen unit 630.

As shown in FIG. 23, the acceleration unit 610 includes a pair of acceleration pipes 621 connected at their one ends with respective ends of water supplying hoses 22 for a warm water and a cold water. Each acceleration pipe 621 is downwardly bent such that the other end thereof extends toward the filtering screen unit 630 seated on the detergent containing unit 620. Each acceleration pipe 621 is also provided at its circumferential portion with a plurality of air ports 621*a* for allowing external air to be introduced in the acceleration pipe 621.

The detergent containing unit 620 comprises an outer container body 621 fixedly mounted in the washer body 1 and an inner container body 622 slidably fitted in the outer container body 621.

Seated on the upper end of inner container body 622 is the filtering screen unit 630 containing the detergent C supplied from the detergent supplying unit 650, but not dissolved yet. In the inner container body 622, an overflow plate 622*a* is vertically mounted to be properly spaced from one side portion of the inner container body 622. The overflow plate 622*a* serves to allow an overflow of an amount of washing water exceeding a predetermined level in the inner container body 622 so that the overflowing washing water can be discharged toward the dehydrating tub 4 via a passage defined between the overflow plate 622*a* and the one side portion of inner container body 622. At the lower end of the one side portion of inner container body 622, a discharge pipe 622*b* is provided, which is bent such that its discharge end extends toward the inner side wall surface of the dehydrating tub 4. With such a bent construction of the discharge pipe 622*b*, the washing water from the discharge pipe 622*b* is discharged toward and along the inner side wall surface of dehydrating tub 4, thereby preventing an occurrence of foams.

It is preferred to form the discharge pipe 622*b* to have a curved shape. A filter fixing member 624 is threadedly connected to the discharging end of discharge pipe 622*b* so that a filter member 623 is interposed between the filter fixing member 624 and the discharging end of discharge pipe 622*b*.

The detergent supplying unit 650 which is disposed at one side of the top portion of detergent containing unit 620 comprises a detergent storing container 651 fixedly mounted to the washer body 1 and adapted to store a predetermined amount of detergent C therein. At the lower portion of detergent storing container 651, a laterally extending coil 652 is rotatably mounted. Above the coil 652, a worm 653 is rotatably mounted such that it is engaged with the coil 652. The worm 653 serves to feed the detergent C in the form of powder to the filtering screen unit 630, by its rotation.

The coil 652 is coupled at one end thereof with a gear 655*a* which is engaged with a gear 655*b* coupled to a rotation shaft of a drive motor 654 so that a rotation force from the drive motor 654 is transmitted to the coil 652. At the other end of coil 652, the detergent storing container 651 has an opening 656 for discharging the detergent C to the filtering screen unit 630. The detergent storing container 651 is also provided with an opened upper portion through which detergent can be poured in the detergent storing container 651. The detergent storing container 651 also has a lid 657 pivotally mounted to the opened upper portion.

Upon washing, first, clothes to be washed are poured in the dehydrating tub 4. Thereafter, a washing condition is selected by manipulating a manipulation unit not shown, so that a washing is carried out according to the selected washing condition.

At this time, a washing water is supplied in the acceleration unit 610 and a predetermined amount of detergent C is supplied in the filtering screen unit 630 seated on the detergent containing unit 620 according to an operation of the detergent supplying unit 650.

That is, as the coil 652 rotates, the worm 653 rotates and feeds the detergent C along the rotating coil 652 to the opening 656.

The detergent C which is poured in the detergent containing unit 620 through the opening 656 is stored in the screen member 631 and then primarily dissolved in the washing water supplied from the acceleration unit 610, by the pressure of the washing water. Together with the washing water, the detergent C passing through the screen member 631 is introduced in the inner container body 622.

Since a plurality of air ports 621*a* are provided at the circumferential wall of each acceleration pipe 621, the internal pressure of the acceleration pipe 621 is increased by external air introduced in the acceleration pipe 621 through the air ports 621*a*, so that the solubility of detergent C is more enhanced.

The washing water introduced in the inner container body 622 after passing through the screen member 631 forms a vortex flow in the inner container body 622 so that the detergent C not dissolved yet can be completely dissolved. The washing water including the detergent C dissolved therein is then discharged toward the dehydrating tub 4 through the discharge pipe 622*b*.

At this time, the washing water may include fine detergent particulates not dissolved yet and foreign materials. These materials are filtered by the filter member 623 disposed at the discharge end of discharge pipe 622*b*. Accordingly, it is possible to prevent the clothes from being damaged by detergent lumps during or after the washing.

As the discharge pipe 622*b* has a bent construction such that its discharge end extends toward the inner side wall surface of dehydrating tub 4, the washing water is discharged toward and along the inner side wall surface of dehydrating tub 4, thereby enabling an occurrence of foams due to the detergent C to be minimized.

As apparent from the above description, in the detergent dissolving device of the sixth embodiment, a proper amount of detergent can be automatically supplied according to the detergent supplying unit. Accordingly, there is an advantage of a convenience in use. An improved solubility of detergent can be also obtained, in that the solution of detergent is achieved by the pressure of washing water supplied. It is also possible to increase the washability and reduce the environmental contamination.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A detergent dissolving device, comprising a detergent container for containing detergent powder; said container having a water inlet for receiving water, and a water outlet for discharging water and dissolved detergent into a tub; water accelerating means for accelerating the speed of water being supplied to said water inlet, said water accelerating means including a connecting pipe having first and second oppositely disposed pipe portions for connection with a warm water hose and a cold water hose, respectively, an acceleration pipe having first and second ends, said first end being fitted in said connecting pipe, said acceleration pipe forming therein first and second tapered conduits which taper from said first end to said second end, each of said tapered conduits including an inlet at said first end and an outlet at said second end, said inlets of said first and second tapered conduits communicating with said first and second pipe portions, respectively, said outlets of said first and second tapered conduits communicating with said water inlet of said container, and an acceleration cap extending around said second end of said acceleration pipe, said acceleration cap including a side wall, and an air port formed therein for communicating said outlets of said first and second tapered conduits with external air; and a filter mounted to the container in the path of water flowing through said water inlet of said container, said filter including a dense screen member for holding detergent.

2. The device according to claim 1, wherein said detergent container includes an outer body forming said water inlet, and an inner body which is slidable into and out of said outer body, said inner body including means for supporting said filter such that said filter is situated beneath said water inlet when said inner body has been slid into said inner body.

3. The device according to claim 2, wherein said filter is removably supported on said inner body.

4. The device according to claim 3, wherein said inner body includes two parallel vertical walls, and grooves formed in said parallel walls, said filter including protrusions disposed at an upper end thereof and receivable in respective ones of said grooves.

5. The device according to claim 4, wherein said filter is of generally conical configuration.

* * * * *